US007243660B2

(12) United States Patent
Capristo

(10) Patent No.: US 7,243,660 B2
(45) Date of Patent: Jul. 17, 2007

(54) HAIR COLORING APPARATUS, KIT AND ASSOCIATED METHODS

(76) Inventor: Michael Capristo, 4719 Triplett Way, Wilmington, NC (US) 28409

( * ) Notice: Subject to any disclaimer, the term of this patent is extended or adjusted under 35 U.S.C. 154(b) by 457 days.

(21) Appl. No.: 10/808,169

(22) Filed: Mar. 24, 2004

(65) Prior Publication Data

US 2004/0221864 A1 Nov. 11, 2004

(51) Int. Cl.
*A61K 7/13* (2006.01)
*B43K 5/04* (2006.01)
*B65D 25/08* (2006.01)

(52) U.S. Cl. ..... 132/208; 132/112; 401/158; 401/202; 206/219

(58) Field of Classification Search ..... 132/112–116, 132/208; 401/132, 133, 151, 158, 156, 176, 401/177, 183, 202, 269; 206/219; 222/129, 222/135, 136
See application file for complete search history.

(56) References Cited

U.S. PATENT DOCUMENTS

| | | | | | |
|---|---|---|---|---|---|
| 1,393,903 | A | * | 10/1921 | Perez et al. | 401/40 |
| 3,720,473 | A | * | 3/1973 | Nakata | 401/40 |
| 3,756,390 | A | * | 9/1973 | Abbey et al. | 206/219 |
| 3,964,643 | A | | 6/1976 | Morane et al. | |
| 4,399,827 | A | | 8/1983 | Fuhs | |
| 5,007,754 | A | * | 4/1991 | Zierhut | 401/174 |
| 5,076,298 | A | | 12/1991 | Busch et al. | |
| 5,333,627 | A | * | 8/1994 | Mehringer et al. | 132/108 |
| 5,337,764 | A | * | 8/1994 | McKay | 132/116 |
| 5,647,481 | A | | 7/1997 | Hundertmark et al. | |
| 5,937,864 | A | | 8/1999 | Diaz | |
| 5,937,866 | A | | 8/1999 | Magharehi | |
| 6,036,005 | A | | 3/2000 | Krause et al. | |
| 6,053,177 | A | | 4/2000 | Sofer | |
| 6,062,230 | A | | 5/2000 | Kajgana | |
| 6,247,586 | B1 | | 6/2001 | Herzog et al. | |
| 6,357,450 | B1 | | 3/2002 | Paice | |
| 2003/0041869 | A1 | | 3/2003 | Dovergne et al. | |
| 2005/0072442 | A1 | * | 4/2005 | Licari et al. | 132/112 |

FOREIGN PATENT DOCUMENTS

| | | | |
|---|---|---|---|
| DE | 39 31 111 | A1 | 3/1991 |
| DE | 100 54 564 | A1 | 5/2001 |
| EP | 1177987 | A2 | 6/2002 |
| EP | 1044893 | B1 | 6/2003 |
| GB | 2 335 179 | A | 9/1999 |
| GB | 2370264 | A | 6/2002 |
| JP | 64-70010 | | 3/1989 |

* cited by examiner

*Primary Examiner*—Todd E. Manahan
(74) *Attorney, Agent, or Firm*—Bracewell & Giuliani LLP

(57) ABSTRACT

A hair coloring apparatus, kit, and related methods are provided. The apparatus includes a container having a medial body portion and an inner container chamber formed in the medial body portion for containing a first hair coloring solution. The container also includes an interior recess for containing a second hair coloring solution and a plunger used for mixing the second hair coloring solution into the first hair coloring solution within the inner chamber. The apparatus also includes a recess closing means such as a valve to isolate the second hair coloring solution from the first hair coloring solution prior to mixing. The apparatus also includes a hair color mixture dispenser connected to the container. The dispenser includes a brush applicator having a plurality of clusters of flexible bristles for applying a hair coloring mixture onto the hair of a user.

45 Claims, 8 Drawing Sheets

HAIR COLORING APPARATUS, KIT AND ASSOCIATED METHODS

BACKGROUND OF THE INVENTION

1. Field of the Invention

The present invention relates to hair care products. More specifically, the present invention relates to an apparatus, kit, and related methods for coloring hair.

2. Description of the Related Art

There exists a multitude of different types of hair coloring systems which utilize various types of hair coloring solutions deployed with use of myriad types of hair coloring dispensers capable of dispensing the various types of hair coloring solutions onto the hair of a user. The hair coloring solutions can be of a type that is either temporary or permanent in nature. Where the hair coloring solution is temporary in nature, many of the various hair coloring solutions can often be stored in a single unitary container with a sufficient shelf life to be sold and used by a user prior to significant alteration of its hair coloring formula. For some of the hair coloring solutions that are temporary in nature and in most solutions which are permanent in nature, the component parts which form the hair coloring solution generally cannot be stored or mixed together for any substantial length of time without a significant alteration in the hair coloring formula. In this situation, it is necessary to store the components of the hair coloring solution in either two or more separate storage containers or store them isolated from each other within a single container. At or near the time the user desires to employ the hair coloring solution, the user mixes the components of the hair coloring solution together, typically in a single container.

Many of the hair coloring systems which store the components of the hair coloring solution in separate containers are considered quite messy by the user due to the requirement for mixing the components of the hair coloring solution prior to use. Spillage resulting in a significant loss of the mixed product often stems from problems encountered during the mixing of the components of the coloring solution. Additionally, many of the users simply do not understand how to properly mix the products much less the importance of mixing the proper quantities. The mixing process often results in contamination of personal property in the surrounding areas where the mixing process was conducted.

The art has tried to solve the problems resulting from storage of the hair coloring components in separate containers and the ensuing problems of combining the two components either directly in a separate container prior to entry into the hair of the user or into a separate mixing chamber within a single container for further expressing into the hair of the user. For example, U.S. Pat. No. 6,357,450B1 by Paice, titled "Hair Dye Applicator," describes a hair dye applicator including a first tubular member having a dye gel within and a second tubular member coupled to the first tubular member and having peroxide within. A trigger and a pair of pistons are used to push the dye gel and peroxide together through a rod where fins mix them together. The mixture is then forced into a manifold and out conduits for positioning on the hair of the user. This type of dispensing device is very complicated due to the numerous parts and connections making this type of dispenser difficult to cost effectively produce as a disposable. Additionally, the numerous parts design requires the user to perform extensive cleaning between uses.

Also, for example, U.S. Pat. No. 6,247,586B1 by Herzog et al., titled "Two-Component Container," describes a two component dispensing container. In this dispenser, a first container having peroxide or hair dye is threadingly connected by the user into a second container having the other of the peroxide or hair dye. During the threading process, a sealing plug separating the two containers is ejected. The sealing plug is then used as a shaking ball to assist in the mixing of the peroxide and the hair dye. This type of dispensing container design requires both of the containers be at least somewhat non-pliable to provide sufficient structure to the threads to allow the individual containers to be threaded together. This tends to result in the dispensing container being expensive to manufacture and difficult to use because the non-pliable structure does not allow easy expressing of the hair coloring solution by the user.

Some of the art has instead tried to solve the mixing problem by storing the components of the hair coloring solution in a single container separated by some form of isolation means. For example, U.S. Pat. No. 3,964,643 by Morane et al., titled "Unpressurized Container for Holding a Plurality of Product Separately and Dispensing Them Simultaneously," describes a dispensing container having a flexible outer jacket having a first component of the hair coloring solution and a glass tube having a second component of the hair coloring solution within. In this form of dispensing container, the two components are mixed by breaking the glass tube. The dispensing container also includes a cloth filter to prevent broken glass shards from being extruded along with the mixed components of the hair coloring solution. Manufacturing costs and safety issues have made this type of device cost prohibitive.

Most, if not all, of hair coloring solution dispensers currently in use, whether having their components stored in separate containers or in isolation within a single container, require some form of mixing other than through natural permeation. Various methodologies implemented to perform this function include shaking the container once the two component parts are placed into a single container. Other methodologies supplement the shaking of the container by including a ball bearing in the mixing container in order to accelerate the mixing process. For example, U.S. Pat. No. 5,937,864 by Diaz, titled "Hair Coloring Applicator with Mixing Chamber," describes a hair coloring applicator including a first chamber having peroxide material within and a separately stored second chamber having hair dye material within. When the second chamber is connected to the first chamber, a membrane in the second chamber is pierced by a frustro-shaped open end of the first chamber to allow the peroxide material and hair dye material to combine. The second container includes a ball bearing to facilitate the mixing of the two components. This ball bearing mixing methodology, however, is often problematic. Ball bearings are generally made of metal. Metals can have a profound adverse reaction to include heat which can be of a sufficient degree to melt the hair. Additional adverse reactions include alteration of the hair color formula itself which would prevent a predictable color result within the hair.

Still others implement mixing of the components by pressing or kneading the mixing container to perform the mixing function. For example, though not involving hair care products, U.S. Pat. No. 6,036,005 by Krause et al., titled "Package for Storing, Mixing, and Dispensing Multi-Component Products," nevertheless describes a package for storing, mixing, and dispensing multi-component products in the form of paints, epoxy adhesives, or epoxy or polyurethane coatings to which a hardener or accelerator are added. The package includes an outer container and an inner container located within the outer container. The outer container is made of a flexible material and has a hardener/accelerator or coating/adhesive/paint within. The inner container is also flexible and has the other of the hardener/accelerator or coating/adhesive/paint within. The inner container has a frictionally retained closure plug capping an opening end. The components of the product are mixed by squeezing the outer container which squeezes the inner container which results in the dislodging of the closure cap. This type of package often succumbs to loss during transportation and handling. Accidental pressure on the package, even for only a moment, can cause release of the plug and inadvertent mixing of the contents of the outer and inner containers, resulting in total loss of the product.

Some devices have attempted to use a piston for mixing and dispensing the hair coloring solution. For example, U.S. Pat. No. 6,053,177 by Sofer, titled "Cartridge For Hair Dye Dispenser" describes a hair dye dispenser which is manually filled by a user with a storage and filling device. The filling device includes a pair of separate hair dye component containers positioned substantially in parallel, whereby a dual piston drives the components from the containers simultaneously into a hair dye dispensing container. The hair dye dispensing container also has a piston whereby a dispensing actuator exerts pressure on the piston to express the mixed hair dye through a plurality of dispensing tines having tip apertures. The design is rather complicated and thus not conducive to being made disposable. Additionally, the cartridge along with the associated filling device and dispensing actuator has multiple parts including a sealing element requiring attachment and/or detachment that can be misplaced by the user. Not being disposable, many of the multiple parts also require extensive cleaning after use, which can be very messy.

Regardless of the methodology employed to produce the mixed hair coloring solution, once mixed, the hair coloring solution must be dispensed onto the hair of the user. Many hair coloring dispensers have teeth (tines) or forks for spreading the hair during the dispensing operation. For example, U.S. Patent App. No. 2003/0041869A1 by Dovergne, titled "Device for Applying a Substance to the Hair," describes a device for applying a substance to dye hair that includes a comb or applicator having teeth that are arranged with gaps between the teeth. The teeth are positioned in such a way as to allow one or more substances, e.g., oxidizer and dye, within the body of the device to be applied onto the hair. Use of the hard teeth (tines) or forks can, however, be problematic and has been equated with trying to paint a wall with the wooden part of a paintbrush. The hair coloring dispenser described in U.K. Patent No. 2,370,264 by Lloyd-Davy, titled "Hair Dye Applicator," and described in other similar devices, may have attempted to solve this problem. The described hair dye applicator includes an applicator comprised of bristles. A felt pad is positioned between the bristles and the application hair dye solution and is used to moisten the bristles of the device. Having such an obstruction extending between the bristles and the hair coloring solution, however, tends to greatly hinder the flow of the hair coloring solution. Thus, Applicant has recognized the need for an applicator having soft bristles and which is designed to easily moisten the bristles to properly apply the hair coloring solution onto the hair of the user.

The above described devices, and some other similar devices, are relatively complex and expensive in construction, and some of them require separate attachments in order to mix the components' solutions with each other. Still others require separate storage containers for the components, which must be combined into a unitary container for dispensing. Thus, Applicant has recognized a need for an apparatus for coloring hair that can hold at least two components separate from one another until it is desired to mix the components to formulate the hair coloring solution and that is not easily inadvertently activated. Also recognized is the need for an apparatus for coloring hair that is disposable and inexpensive to manufacture, relatively simple to use, allows for easy mixing without the use of a ball bearing type device, is designed to help prevent spillage of the mixed hair coloring solution during or after mixing, and which provides an even dispensing of the hair coloring solution via an applicator brush having soft bristles.

SUMMARY OF THE INVENTION

In view of the foregoing, embodiments of the present invention advantageously provide an apparatus and methods related to use of a hair coloring apparatus that provides a user the ability to color the hair of the user with minimal cleanup requirements. Advantageously, embodiments of the present invention also provide a disposable hair color container that includes a one-way valve that allows mixing of a pair of hair coloring solutions both pre-positioned separately within a single container, and that helps prevent inadvertent activation of the hair coloring solutions. Advantageously, embodiments of the present invention also provide a hair color container including a plunger for mixing a pair of separately positioned hair coloring solutions. Advantageously, embodiments of the present invention also provide a hair color mixture dispenser including a brush applicator having a plurality of clusters of flexible bristles to provide substantially uniform lengthwise distribution of the hair color mixture. Advantageously, embodiments of the present invention also provide a kit including a hair color dispensing container and provisions for forming a hair color mixture and dispensing said mixture. Advantageously, embodiments of the present invention also provide methods of forming a hair color mixture and dispensing and applying such mixture.

More particularly, an embodiment of the present invention provides a container including an inner container chamber formed in a medial body portion of the container to contain a first hair coloring solution therein, and an interior recess inwardly extending from a proximal body end portion into the medial body portion to contain a second hair coloring solution therein. At least one recess opening is formed in the interior recess and that extends from interior recess surface regions of the interior recess through outer recess surface regions of the interior recess and into the inner container chamber. A valve is positioned adjacent the at least one recess opening to close the at least one recess opening formed in the interior recess to thereby isolate the second hair coloring solution from the first hair coloring solution. This configuration is implemented so that the second hair coloring solution, when positioned in the interior recess, is prevented from readily flowing from the interior recess into the inner container chamber. Though each individual hair coloring solution (e.g., a hair color dye and a developing solution), when in a separate and uncombined form have relatively lengthy shelf lives, once mixed, the shelf life of the mixture resulting from the combination of the hair coloring solutions can be reduced to that of hours or even minutes.

The apparatus for coloring hair can also include a plunger having a distal plunger end portion positioned in the interior recess adjacent the proximal body end portion of the medial body portion of the container. The plunger is further adjacent the second hair coloring solution so that positive pressure on the plunger induced by a user opens the valve to allow the first and the second hair coloring solutions to mix in the inner container chamber to thereby form the hair color mixture within the inner container chamber. The interior recess can be sized such that when the interior recess is substantially filled with the second hair coloring solution, mixing the first hair coloring solution with the second hair coloring solution results in a desired hair color formula or mixture. The hair color mixture is formed as a result of the passage of the second hair coloring solution from within the interior recess through the at least one recess opening and into the inner container chamber. The inner container chamber initially only contains the first hair coloring solution, but application of the pressure via the plunger results in the inner container chamber containing a mixture of both the first and the second hair coloring solutions. Thus, application of pressure to the plunger to extrude substantially all of the second hair coloring solution into the inner chamber results in such a desired mixture.

The valve, which can be positioned within the inner container chamber and adjacent the outer recess surface regions, can not only function to separate the hair coloring solutions during storage to prevent inadvertent mixing of the solutions and respond to positive pressure on the plunger to open the at least one recess opening to allow user initiated mixing of hair coloring solutions, but can also serve to re-cover the at least one recess opening in response to a release of the positive pressure on the plunger induced by the user to thereby close the valve to prevent the hair color mixture from flowing out from the inner container chamber and into the interior recess during extrusion of the care color mixture to the hair of the user.

The apparatus further provides a hair color mixture dispenser connected to an open distal body end portion of the container to dispense hair color mixture therefrom. The hair color mixture dispenser includes a brush applicator having a proximal brush applicator end, a distal brush applicator end, a plurality of hair color mixture extrusion channels positioned between the proximal brush applicator end and the distal brush applicator end. The brush applicator also includes a plurality of flexible bristles associated with the distal brush applicator end, which can be positioned along a length of the distal brush applicator end. Each of the plurality of flexible bristles can be positioned adjacent at least one of the plurality of hair color mixture extrusion channels. This positioning of the bristles is accomplished to help provide substantially uniform lengthwise distribution of the hair coloring mixture.

The brush applicator also can include an extrusion channel closing valve. In an embodiment of the present invention, the extrusion channel closing valve is connected between the open distal body end portion of the container and the proximal brush applicator end of the brush applicator to selectively close the hair color mixture extrusion channels so that the hair color mixture within the inner container chamber is prevented from flowing into the plurality of hair color mixture extrusion channels. The extrusion channel closing valve can include a rotatable closure cap having a plurality of rotatable closure cap openings in fluid communication with a corresponding plurality of the hair color mixture extrusion channels. Rotating the closure cap in a first direction allows the hair color mixture to flow through the plurality of rotatable closure cap openings and rotating the rotatable closure cap in a second direction substantially prevents the hair color mixture from flowing through the plurality of rotatable closure cap openings. In an alternative embodiment of the present invention, the extrusion channel closing valve is connected adjacent the distal brush applicator end of the brush applicator to selectively close the hair color mixture extrusion channels. A multi-prong closure cap is positioned adjacent the distal brush applicator end and has a plurality of teeth each sealingly positioned within one of the plurality of hair color mixture extrusion channels. This can provide the ability to selectively close the hair color mixture extrusion channels so that hair color mixture within the inner container chamber is prevented from flowing out of the plurality of hair color mixture extrusion channels.

The proximal brush applicator end can include a proximal lengthwise extent and a proximal widthwise extent, and the distal brush applicator end can include a distal lengthwise extent and a distal widthwise extent. The distal widthwise extent can be substantially shorter than the proximal widthwise extent such that each of the plurality of hair color mixture extrusion channels is positioned spaced apart in a single row along the distal lengthwise extent of the distal brush applicator end to further provide substantially uniform lengthwise distribution of the hair color mixture.

The present invention also advantageously provides a kit for coloring hair. The kit includes a kit container and a hair color mixture dispensing container positioned within the kit container. The hair color mixture dispensing container includes an inner dispensing container chamber formed in a medial body portion of the dispensing container containing a first hair coloring solution therein, and an interior recess inwardly extending from a proximal body end portion into the medial body portion containing a second hair coloring solution therein. At least one recess opening is formed in the interior recess and extends from interior recess surface regions of the interior recess through outer recess surface regions of the interior recess and into the inner dispensing container chamber. A flexible valve recess opening cover can be positioned over the at least one recess opening to close the at least one recess opening formed in the interior recess to thereby isolate the second hair coloring solution from the first hair coloring solution so that the second hair coloring solution positioned in the interior recess is prevented from readily flowing from the interior recess into the inner dispensing container chamber.

A plunger is also positioned within the kit container. The plunger has a distal plunger end portion positioned in the interior recess adjacent the second hair coloring solution so that positive pressure on the plunger induced by a user opens the flexible valve recess opening cover to allow the first and second hair coloring solutions to mix in the inner dispensing container chamber. The second hair coloring solution passes from within the interior recess through the at least one recess opening to thereby form a hair color mixture within the inner dispensing container chamber. The at least one recess opening can include a plurality of recess openings. In such case, the flexible valve cover can be further positioned in a surrounding relationship over the plurality of recess openings to close the plurality of recess openings formed in the interior recess. The flexible valve recess opening cover can be responsive to the positive pressure applied to the inner recess by the plunger to thereby expand the valve recess cover to uncover the plurality of recess openings to allow the second hair coloring solution to mix with the first hair coloring solution in the inner dispensing container chamber.

The kit also includes a hair color mixture dispenser positioned in the kit container and connected to an open distal body end portion of the dispensing container to dispense hair color mixture therefrom. The hair color mixture dispenser includes a brush applicator having a proximal brush applicator end including a proximal lengthwise extent and a proximal widthwise extent, and a distal brush applicator end including a distal lengthwise extent and a distal widthwise extent. The distal widthwise extent is substantially shorter than the proximal widthwise extent.

A plurality of hair color mixture extrusion channels is positioned between the proximal brush applicator end and the distal brush applicator end. The brush applicator also includes a plurality of flexible bristles associated with the distal brush applicator end. Each can be positioned in a single row along the distal lengthwise extent of the distal brush applicator end and can be positioned adjacent at least one of the plurality of hair color mixture extrusion channels to provide substantially uniform lengthwise distribution of the hair color mixture. An extrusion channel closing valve can be positioned adjacent the open distal body end portion of the container and the proximal brush applicator end of the brush applicator to close the hair color mixture extrusion channels so that the hair color mixture within the inner container chamber is prevented from flowing into the plurality of hair color mixture extrusion channels.

The present invention also includes methods of using an apparatus for coloring hair. For example, according to an embodiment of the present invention, a method of using an apparatus for coloring hair includes applying pressure against a first hair coloring solution contained within an interior recess that inwardly extends into an inner container chamber of a container which contains a second hair coloring solution. The pressure applied against the first hair coloring solution expands a flexible valve cover positioned in a surrounding relationship over at least one recess opening formed in the interior recess. The application of pressure induced by the user against the first hair color solution can be through use of positive pressure on a plunger having a distal plunger end portion positioned in the interior recess adjacent the first hair coloring solution.

The expansion results in uncovering the at least one recess opening to allow the first and second hair coloring solutions to mix in the inner container chamber. The mixing of the first and second hair coloring solutions results in the formation of a hair color mixture positioned within the inner container chamber and is accomplished as a result of the passage of the first hair coloring solution from within the interior recess through the plurality of recess openings and into the inner container chamber containing the second hair coloring solution. Releasing the application of pressure on the plunger after forming the hair color mixture causes the flexible valve cover to contract and thus to re-cover the plurality of recess openings to prevent the hair color mixture from flowing from the inner container chamber and into the interior recess. This functional structure helps prevent inadvertent removal of the plunger and inadvertent extrusion of the hair coloring mixture through the interior recess.

The method further includes dispensing the hair color mixture. In an embodiment of the present invention, the user rotates a rotatable closure cap to an open position and squeezes a flexible medial body portion of the container to extrude the hair color mixture onto the hair of the user. The extrusion is accomplished by passage of the hair color mixture from within the inner container chamber through a plurality of hair color mixture extrusion channels and to a plurality of flexible bristles adapted to be brushed through the hair of the user.

In another example of an embodiment of using an apparatus for coloring hair, the method can include dispensing the hair color mixture onto the hair of a user by removing a multi-prong closure cap positioned adjacent a distal brush applicator end of a brush applicator. The multi-prong closure cap has a plurality of teeth each sealingly positioned within one of the plurality of hair color mixture extrusion channels. The user squeezes a flexible medial body portion of a container connected to the brush applicator to extrude the hair color mixture by passage of the hair color mixture from within an inner container chamber through a plurality of hair color mixture extrusion channels and to a plurality of flexible bristles positioned in a row along a distal lengthwise extent of the distal brush applicator end. The user applies a substantially uniform lengthwise distribution of the hair color mixture in a single stroke to a lengthwise area of a portion of the hair of the user by brushing the plurality of flexible bristles against the hair while dispensing the hair coloring mixture.

Advantageously, embodiments of the present invention include an apparatus for coloring hair that is disposable and inexpensive to manufacture, relatively simple to use, allows for easy mixing without the use of a ball bearing type device, is designed to help prevent spillage of the mixed hair coloring solution during or after mixing, and which provides an even dispensing of the hair coloring solution via an applicator brush having soft bristles. Advantageously, embodiments of the apparatus do not require separate storage containers for the component solutions which must be later combined into a unitary container for dispensing. Advantageously, embodiments of the apparatus can bold at least two components separate from one another in a single container until it is desired to mix the components to formulate the hair color mixture. Advantageously, an apparatus for coloring hair according to an embodiment of the present invention does not generally require separate attachments in order to mix the components solutions with each other.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers generally refer to like elements throughout. Prime notation, if used, indicates similar elements in alternative embodiments.

Figure 1:
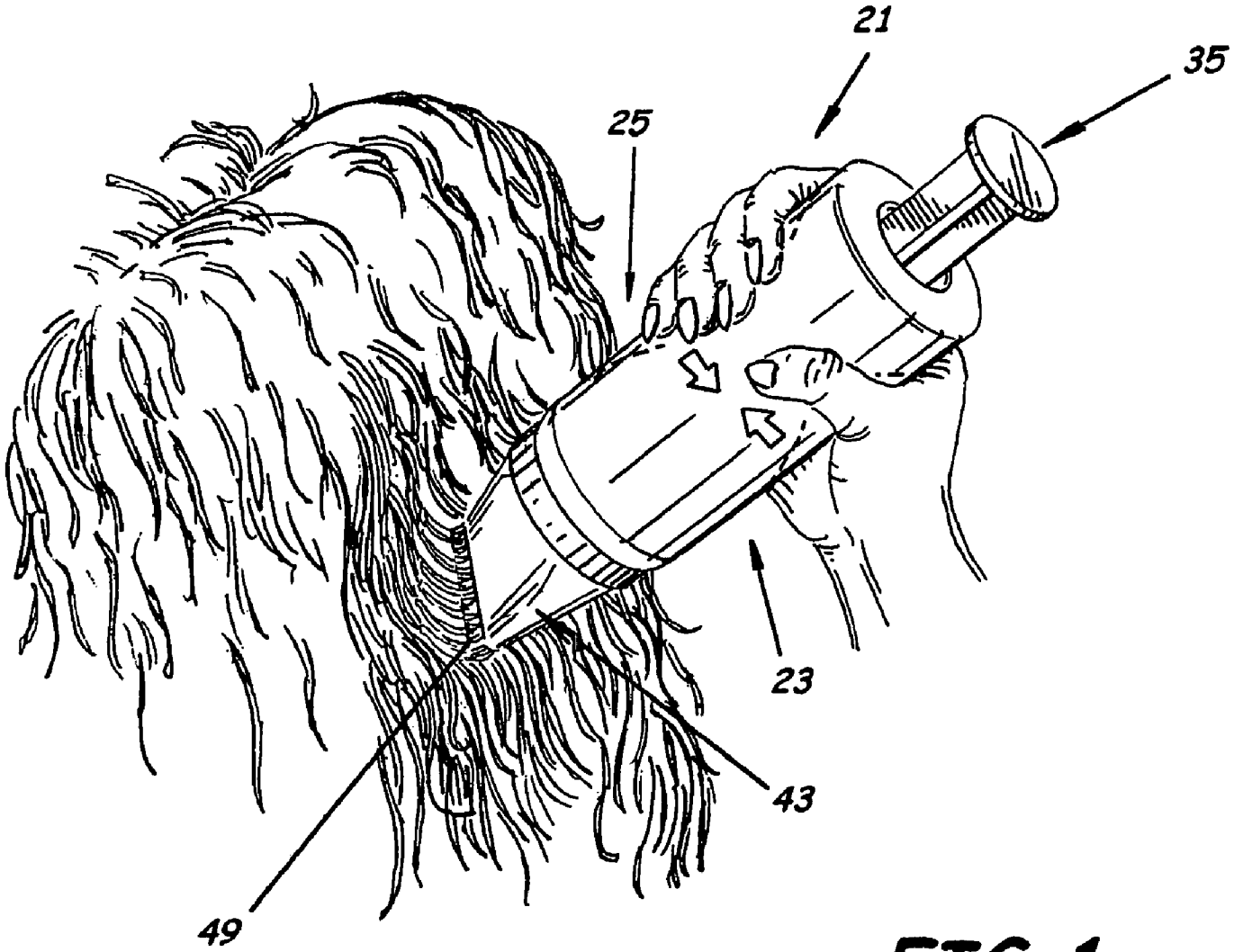
FIG. 1 is an environmental view of an apparatus for coloring hair, according to an embodiment of the present invention.
Figures 2, 3:
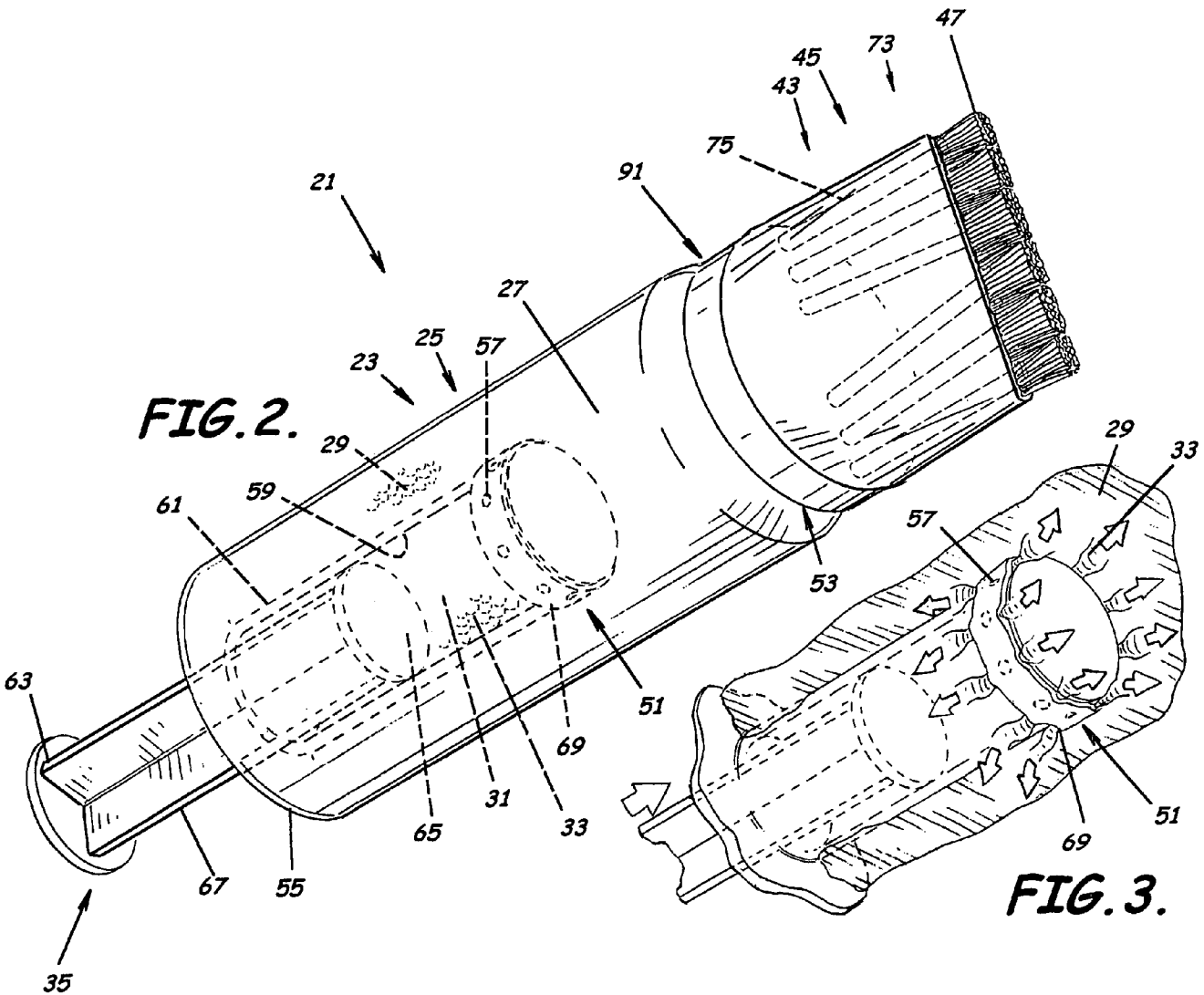
FIG. 2 is perspective view of an apparatus for coloring hair, according to an embodiment of the present invention.
FIG. 3 is an enlarged fragmentary perspective view of an apparatus for coloring hair, according to an embodiment of the present invention.

As illustrated in FIGS. 1–4, and 6–8, embodiments of the present invention advantageously provide an apparatus 21 for coloring hair. In an embodiment of the present invention, as perhaps is shown in FIG. 2, the apparatus 21 includes a container 23 having a medial body portion 25 and a inner container chamber 27 formed in the medial body portion 25 for containing a first hair coloring solution 29. The container 23 also includes an interior recess 31 for containing a second hair coloring solution 33 and a plunger 35 used for mixing the second hair coloring solution 33 into the first hair coloring solution 29 within the inner container chamber 27. The apparatus 21 also includes a hair color mixture dispenser 43 connected to the container 23 and includes a brush applicator 45 having a plurality of flexible bristles 47 for applying a hair coloring mixture 49 to the hair of a user. As shown in FIGS. 2 and 3, the apparatus 21 also includes a recess closing means such as a valve 51 to isolate the second hair coloring solution 33 from the first hair coloring solution 29. Note, other configurations of the apparatus 21 for coloring hair can be used as well according to an embodiment of the present invention. Note also, the term "hair coloring solution" includes but is not limited to hair coloring dye, bleach, and developer.

More specifically, an embodiment of an apparatus 21 of the present invention advantageously provides a container 23 having an open distal body end portion 53, a substantially closed proximal body end portion 55, and a medial body portion 25 connected to and extending between the open distal body end portion 53 and the closed proximal body end portion 55. An inner container chamber 27 is formed in the medial body portion 25 of the container 23 to contain a first hair coloring solution 29 therein, and an interior recess 31 inwardly extends from the proximal body end portion 55 of the container 23 into the medial body portion 25 to contain a second hair coloring solution 33 therein. At least one but preferably a plurality of recess openings 57 are formed in the interior recess 31 and extend from interior recess surface regions 59 of the interior recess 31 through outer recess surface regions 61 of the interior recess 31, and into the inner container chamber 27.

Recess closing means is positioned adjacent the plurality of recess openings 57 to close the plurality of recess openings 57 formed in the interior recess 31 to thereby isolate the second hair coloring solution 33 from the first hair coloring solution 29. This is structured so that the second hair coloring solution 33, when positioned in the interior recess 31, is prevented from readily flowing from within the interior recess 31 into the inner container chamber 27. Though each individual hair coloring solution 29, 33, such as, for example, a hair color dye and a developing solution, when in a separate and uncombined form have relatively lengthy shelf lives, once mixed, the shelf life of the mixture 49 resulting from the combination of the hair coloring solutions 29, 33, can be reduced to that of hours or even minutes.

The recess closing means introduced above is preferably in the form of a valve 51. Various implementations of valve architecture are well-known to those skilled in the art and can include a check valve or other one-way valve, a flapper-type valve, and a gate valve, just to name a few. Valve 51, however, provides some distinct advantages with respect to storing and mixing the first and second hair coloring solutions 29, 33. Implementation of an illustrative embodiment of the recess closing means in the form of valve 51, will be discussed later.

A plunger 35 having a proximal plunger end portion 63, a distal plunger end portion 65, and an elongated neck 67, can be provided. The distal plunger end portion 65 is positioned in the interior recess 31 adjacent the proximal body end portion 55 of the medial body portion 25 of the container 23. The plunger 35 can be further adjacent and in contact with the second hair coloring solution 33 such that positive pressure on the plunger 35 induced by the user opens the recess closing means, shown as valve 51, to allow the first and second hair coloring solutions 29, 33, to mix in the inner container chamber 27 to thereby form a hair color mixture 49 within the inner container chamber 27. The interior recess 31 can be sized such that when the interior recess 31 is substantially filled with the second hair coloring solution 33, mixing the first hair coloring solution 29 with the second hair coloring solution 33 results in a desired hair color formula or mixture 49. The hair color mixture 49 is formed as a result of the passage of the second hair coloring solution 33 from within the interior recess 31 through the plurality of recess openings 57 and into the inner container chamber 27.

The inner container chamber 27 initially only contains the first hair coloring solution 29, but, as perhaps best shown in FIG. 3, application of the pressure via the plunger 35 results in the inner container chamber 27 containing a mixture 49 of both the first and the second hair coloring solutions 29, 33. Thus, application of pressure to the plunger 35 to extrude substantially all of the second hair coloring solution 33 into the inner container chamber 27 results in such a desired formula or mixture 49.

The plunger 35 can include a plunger release to prevent inadvertent extrusion of the second hair coloring solution 33 into the inner chamber 27. The plunger release, illustrated as pin 36 in FIG. 6, need not, however, be a pin in the normal sense. Though preferably in the form of a cotter pin or breakaway peg, the plunger release can also be in the form of a removable collar or breakaway band at least partially surrounding the elongated neck 67 of plunger 35.

As perhaps best shown in FIG. 3, and as noted above, the recess closing means can be in the form of the valve 51 having flexible valve cover 69 which can be positioned within the inner container chamber 27, adjacent the outer recess surface regions 61 of the interior recess 31. The flexible valve cover 69 can be further positioned in a surrounding relationship over the plurality of recess openings. The valve 51 can function beyond separating the hair coloring solutions 29, 33, during storage, in order to prevent inadvertent mixing of the hair coloring solutions 29, 33 and responding to positive pressure on the plunger 35 to open at least one but preferably the plurality of recess openings 57 to allow user initiated mixing of hair coloring solutions 29, 33.

The flexible valve cover 69 is responsive to the positive pressure on the plunger 35 induced by the user to thereby expand the flexible valve cover 69 to uncover the plurality of recess openings 57 to allow the second hair coloring solution 33 to extrude through the plurality of recess openings 57 into the inner container chamber 27 to cause a mixing of the second hair coloring solution 33 with the first hair coloring solution 29 in the inner container chamber 27. Correspondingly, the flexible valve cover 69 is responsive to a release of the positive pressure on the plunger 35 induced by the user to thereby contract the flexible valve cover 69 to re-cover the plurality of openings 57 to prevent the hair color mixture 49 from flowing from the inner container chamber 27 into the interior recess 31, for the reasons described above.

In order to best accomplish such objective, the flexible valve cover 69 can include a band of material. Vitro is the preferred material due to its chemical composition and ability to withstand chemical break down caused by the first and second hair coloring solutions 29, 33, equivalent to approximately at least the shelf life of such solutions, and the ability to withstand chemical break down caused by the hair color mixture 49, once formed. Alternative compositions of the flexible cover 69 can include materials such as polypropylene and polyurethane or other plastics, but these alternatives typically tend to lack the required flexibility. Other materials such as an elastic latex, elastic rubber, or other elastic material with similar elastic properties, as known and understood by those skilled in the art, are also candidates, but tend to have a shorter shelf life than either vitro or plastics.

The valve 51, more specifically flexible valve cover 69, can also serve to re-cover the recess opening(s) 57 in response to a release of the positive pressure on the plunger 35 induced by the user which results in closure of the valve 51. The closing of the valve 51 upon release of pressure prevents the newly created hair color mixture 49 from back-flowing out from the inner container chamber 27 and into the interior recess 31 during extrusion of the hair color mixture 49 to the hair of the user. Depending upon the configuration of the proximal end of the interior recess 31, this feature can also prevent removal of the plunger 35 from the interior recess 31.

In an embodiment of the present invention, where a plunger 35 is used to create the pressure, backflow of the mixture 49 through the plurality of recess openings 57 into the interior recess 31 could result in the plunger 35 being extended out of the proximal end of the interior recess 31, resulting in inadvertent leakage of the hair color mixture 49, and thus, failure of the apparatus 21. This feature can also serve to prevent nondestructive removal of the plunger 35 after mixing has occurred. Attempted extrication via retraction of the plunger 35 would result in a vacuum being created due to the closing of the valve 51, providing a force to prevent such attempted extrication of the plunger 35.

Figure 6:
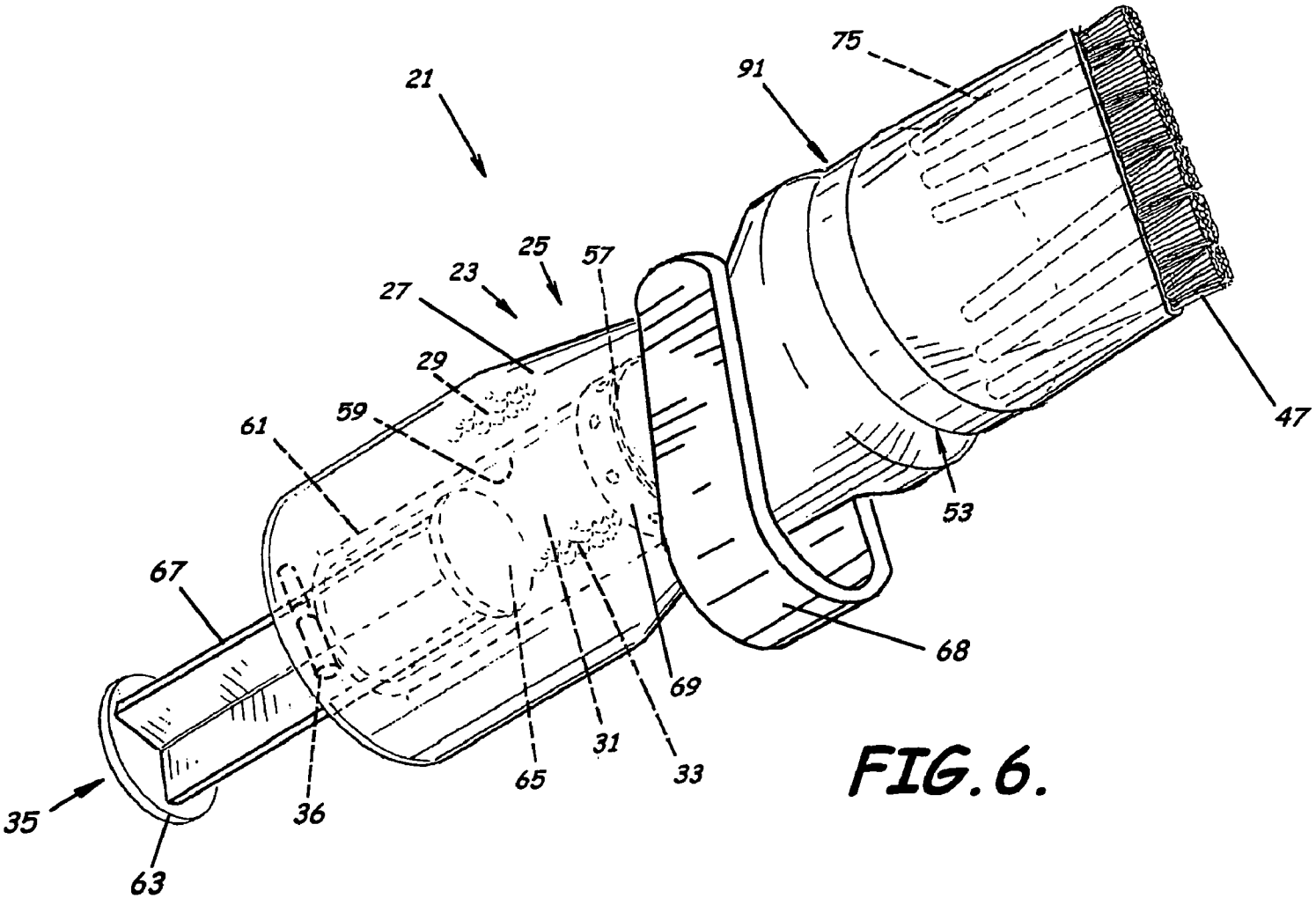
FIG. 6 is a perspective view of an apparatus for coloring hair, according to an embodiment of the present invention.

As perhaps best shown in FIGS. 1 and 6, the medial body portion 25 of the container 23 includes a deformable flexible material, known to those skilled in the art, which can include various forms of plastics and deformable metals, just to name a few. Implementation with a deformable flexible material allows a user to squeeze the medial body portion 25 of the container 23 to extrude the hair color mixture 49 onto the hair of the user by passage of the hair color mixture 49 from within the inner container chamber 27. The interior recess 31 of the medial body portion 25 of the container 23 can include a semi-rigid or rigid material to support the plunger 35. The plunger 35 is configured to fit closely and in sliding abutment with the interior recess surface regions 59 of the interior recess 31 to further substantially prevent incidental extrusion of the second hair coloring solution 29 around the distal plunger end portion 65 of the plunger 35, especially during the application of pressure to the second hair coloring solution 29 with the plunger 35.

As shown in FIG. 6, a medial body compression clasp 68 can be positioned in a surrounding relationship to a section of the medial body portion 25 of the container 23. The medial body compression clasp 68 compresses the deformable flexible material of the medial body portion 25 of the container 23 to thereby regulate the internal volume of the inner container chamber 27 of the container 23 to prevent self-expansion of the medial body portion 25 of the container 23. In some embodiments of valve 51, inadvertent expansion of the medial body portion 25 can result in a vacuum which can tend to draw the second hair coloring solution 33 through the recess openings 57, and thus cause premature mixing of the hair coloring solutions 29, 33. The clasp 68 helps prevent such occurrence.

Figure 4:
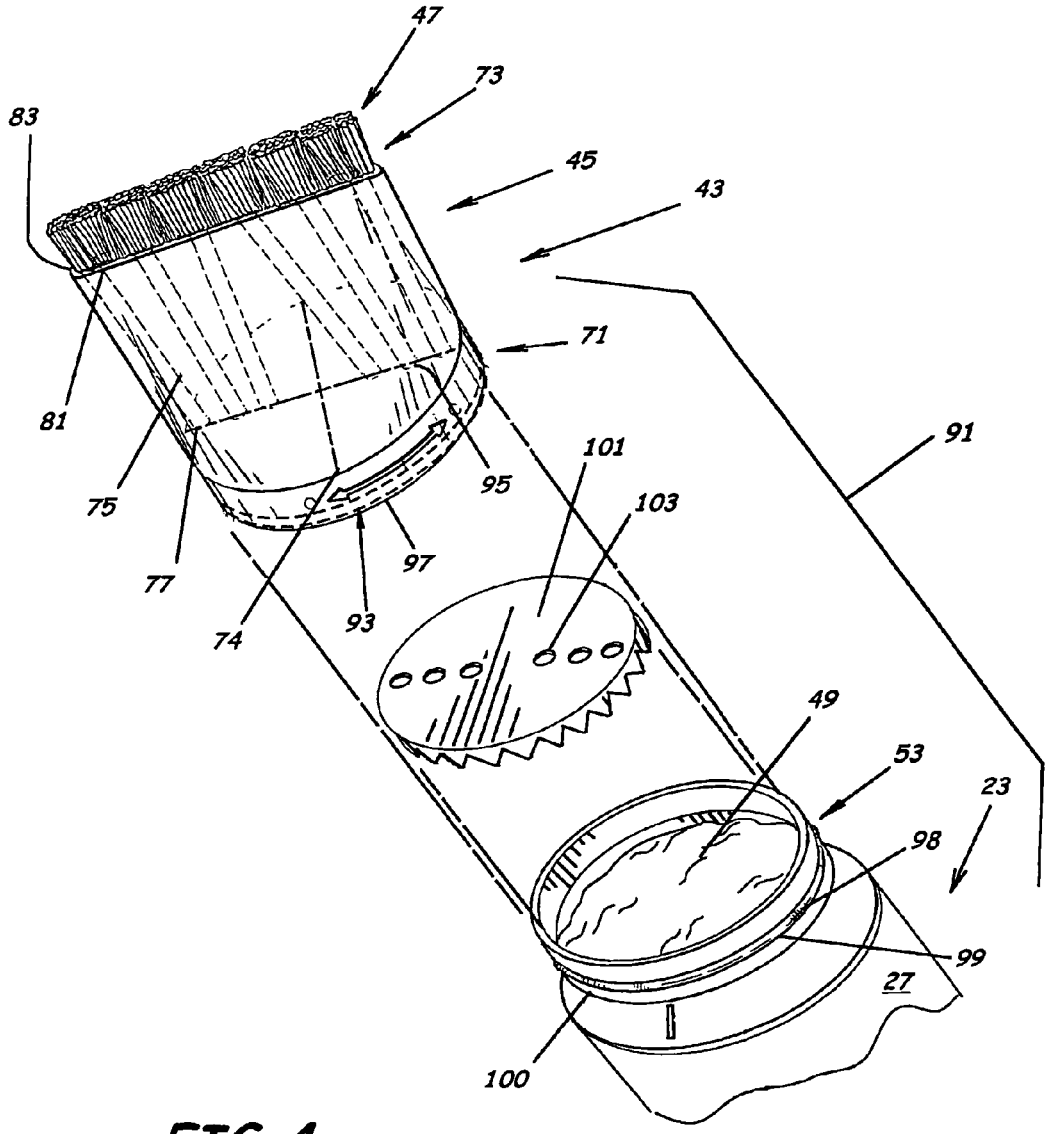
FIG. 4 is an enlarged fragmentary partially exploded perspective view of an apparatus for coloring hair, according to an embodiment of the present invention.

As shown in FIGS. 2 and 4, a hair color mixture dispenser 43 is connected to the open distal body end portion 53 of the container 23 to dispense hair color mixture 49, therefrom. The hair color mixture dispenser 43 includes a brush applicator 45 having a proximal brush applicator end 71, a distal brush applicator end 73, and a plurality of hair color mixture extrusion channels 75 positioned between the proximal brush applicator end 71 and the distal brush applicator end 73. The proximal brush applicator end 71 can include a proximal lengthwise extent 77 and a proximal widthwise extent 79, and the distal brush applicator end 73 can include a distal lengthwise extent 81 and a distal widthwise extent 83. The distal widthwise extent 83 can be substantially shorter than the proximal widthwise extent 79 such that each of the plurality of hair color mixture extrusion channels 75 can be positioned spaced apart in a single row along the distal lengthwise extent 81 of the distal brush applicator end 73. This sizing can further provide substantially uniform lengthwise distribution of the hair color mixture 49, thus providing the user an enhanced ability to quickly apply the hair color mixture 49 onto the hair of the user.

In an embodiment of the present invention, as perhaps best shown in FIG. 2, the hair color mixture dispenser 43 is relatively permanently affixed to the open distal body end portion 53 of the container 23 to prevent separation of the hair coloring dispenser 43 from the open distal body end portion 53 of the container 23 by the user to thereby prevent spilling of the first hair color solution 29 or the hair color mixture 49, once mixed. In an embodiment of the present invention, the hair color mixture dispenser 43 can instead be integral with the open distal body end portion 53 of container 23 to even further prevent opening of the container 23 which can result in spilling of either the first hair coloring solution 29 or the hair color mixture 49.

As shown in FIG. 4, the brush applicator 45 also can include a plurality of flexible bristles 47 associated with the distal brush applicator end 73, which can be positioned along a length of the distal brush applicator end 73, adjacent at least one of the plurality of hair color mixture extrusion channels 75, and preferably further positioned in a surrounding relationship to at least one of the plurality of hair color mixture extrusion channels 75. This positioning can provide concentrated wetting of each of the plurality of flexible bristles 47 positioned therewith, yet help prevent oversaturation and pooling of extruded hair color mixture 49. This positioning can also help further provide substantially uniform lengthwise distribution of the hair color mixture 49, both to the plurality of flexible bristles 47, and to the hair of the user. Additionally, each of the plurality of hair color mixture extrusion channels 75 can be substantially unobstructed adjacent the distal brush applicator end 73.

Each of the plurality of flexible bristles 47 can be in the form of flexible plastic bristles, as illustrated. Alternatively, the flexible bristles 47 can, however, include other forms of applicators, such as, for example, strands of cloth, yarn, fabric, string, or sponge-type material. Flexible bristles 47, such as flexible plastic bristles have been determined to best provide for a sufficient amount of retention of the dispensed hair color mixture 49 prior to application of the hair color mixture 49 to the hair of the user, without unduly restricting dispensing of the hair color mixture 49 during application to the hair of the user.

The hair color mixture dispenser 43 can include extrusion channel closing means positioned adjacent the open distal body end portion 53 of the container 23 and the proximal brush applicator end 71 of the brush applicator 45. The extrusion channel closing means can be positioned to selectively close the hair color mixture extrusion channels 75 so that the hair color mixture 49 within the inner container chamber 27 is prevented from flowing into the plurality of hair color mixture extrusion channels 75. There are numerous means known and understood by those skilled in the art for opening and closing extrusion channels 75. For example, as illustrated in FIG. 4, the brush applicator 45 can include an extrusion channel closing valve 91 connected between the open distal body end portion 53 of the container 23 and the proximal brush applicator end 71 of the brush applicator 45. This extrusion channel closing valve 91 can selectively close the hair color mixture extrusion channels 75 so that the hair color mixture 49 within the inner container chamber 27 is prevented from flowing into the plurality of hair color mixture extrusion channels 75. The extrusion channel closing valve 91 can further include a rotatable closure cap 93 preferably integral with the proximal brush applicator end 71 and having a plurality of rotatable closure cap openings 95 in fluid communication with a corresponding plurality of the hair color mixture extrusion channels 75. Rotating the rotatable closure cap 93 in a first (open) direction 0 allows the hair color mixture 49 to flow through the plurality of rotatable closure cap openings 95 and extrusion channels 75. Rotating the rotatable closure cap 93 in a second (closed) direction C substantially prevents the hair color mixture 49 from flowing through the plurality of rotatable closure cap openings 95.

The rotatable closure cap 93 is preferably non-removable in that it cannot be nondestructively removed from a connection with the open distal body end portion 53 of the container 23 in order to prevent inadvertent leakage or spillage of the first hair color solution 29 during transportation or during mixing or the hair color mixture 49 during application of the hair color mixture 49 by the user. The structure necessary to prevent the cap from being nondestructively removed is well known to those skilled in the art. For example, the proximal brush applicator end 71 of the hair color mixture dispenser 43 can be integral with the open distal body end portion 53 of the container 23 in order to prevent the opening of the container 23 by the user and thus, prevent spilling of the hair color mixture 49. As perhaps best shown in FIG. 4, the rotatable closure cap 93 can also include a rotatable closure cap flange 97 positioned at least partially extending along the perimeter of the proximal end of the rotatable closure cap 93. For example, a distal side of the closure cap flange 97 can land in contact with a corresponding proximal side of an open distal body end flange 99 positioned adjacent the open distal body end portion 53 of the container 23. The combination of the flanges 97, 99, can act to form a retention device for retaining the rotatable closure cap 93 adjacent the open distal body end portion 53 of the container 23 and can provide the rotatable closure cap 93 sufficient connectivity to help seal the rotatable closure cap 93 to the open distal body end portion 53 of the container 23. By way of another example, the rotatable cap flange 97 can instead land within an open distal body end recess 100 forming proximal and distal flanges. The open distal body end recess 100 can provide for the positioning of the rotatable closure cap 93 at the mouth of the open distal body end portion 53 of the container 23 and allow for the rotation of the rotatable closure cap 93.

Regardless of whether the retention device is implemented as a pair of flanges such as flanges 97, 99 or a flange such as flange 97 landing in an annular recess such as recess 100, the rotatable closure cap 93 can be sealed to the open distal body end portion 53 to prevent leakage of the hair color mixture 43 by one or more seals means known and understood by those skilled in the art. For example, rotatable cap seal 98, preferably in the form of an O-ring, can be positioned to form a seal between the uppermost portion of the open distal body end portion 53 and the proximal brush applicator end 71, between rotatable cap flange 97 and open distal body end flange 99, or within open distal body end recess 100. In the illustrated embodiment, the rotatable cap seal 98 is compressed within open distal body end recess 100 by rotatable cap flange 97. The rotatable cap seal 98 can perform a dual function of preventing leakage of the hair color mixture 43 while providing a "feel" to the user when opening and closing the rotatable closure cap 93.

Associated closing structures implemented in conjunction with the rotatable closure cap 93 are also well known and understood by those skilled in the art. For example, a membrane 101 made of a rigid, semirigid, or flexible paper, plastic, foil, or film material can be positioned between the open distal body end portion 53 of the container 23 and the rotatable closure cap 93. The membrane 101 can have a plurality of membrane openings 103 preferably spaced apart to coincide with the plurality of extrusion channels 75 and positioned such that they are in fluid communication with the inner container chamber 27 and the rotatable closure cap 93. At least one of the plurality of membrane openings 103 is substantially axially aligned and in fluid communication with at least one of the plurality of closure cap openings 95 when the rotatable closure cap 93 is rotated in the first (open) 0 direction to allow the hair color mixture 49 to flow through the plurality of rotatable closure cap openings 103. Each of the plurality of membrane openings 103 are substantially nonaligned with each of the plurality of closure cap openings 95 when the rotatable closure cap 93 is rotated in the second (closed) C direction to substantially prevent the hair color mixture 49 from flowing through the plurality of rotatable closure cap openings 95. In this embodiment of the present invention, either there is no extrusion channel 75 or extrusion channel opening 103 in the center of the brush applicator 45 or, preferably, at least one of the plurality of extrusion channel 75 is angled away from the center of the proximal brush applicator end 71 of the brush applicator 45, as perhaps best illustrated in FIG. 4.

Also for example, instead of or in addition to the membrane 101, a plurality of cogs (not shown) can be spring biased against a proximal surface of either the membrane 101 or the rotatable closure cap 93 adjacent the plurality of rotatable closure cap openings 95, such that they are substantially aligned with each of the plurality of closure cap openings 95 when the closure cap 93 is in the second (closed) C direction, substantially preventing fluid flow of the hair color mixture 49 through the plurality of rotatable closure cap openings 95. Correspondingly, at least one of the plurality of cogs (not shown) is substantially nonaligned with each of the plurality of closure cap openings 95 when the rotatable closure cap 93 is rotated in the first (open) 0 direction to allow fluid flow of the hair color mixture 49.

The extrusion channel closing means can, for example, instead include a multi-prong closure cap 105 positioned adjacent the distal brush applicator 73 end. The multi-prong closure cap 105 includes a plurality of teeth 107 each sealingly positioned within one of the plurality of hair color mixture extrusion channels 75 to selectively close the hair color mixture extrusion channels 75 so that hair color mixture 49 within the inner container chamber 27 is prevented from flowing out of the plurality of hair color mixture extrusion channels 75. Additionally, other extrusion channel closing means, as known by those skilled in the art, are within the scope of the present invention.

Figures 9, 10:
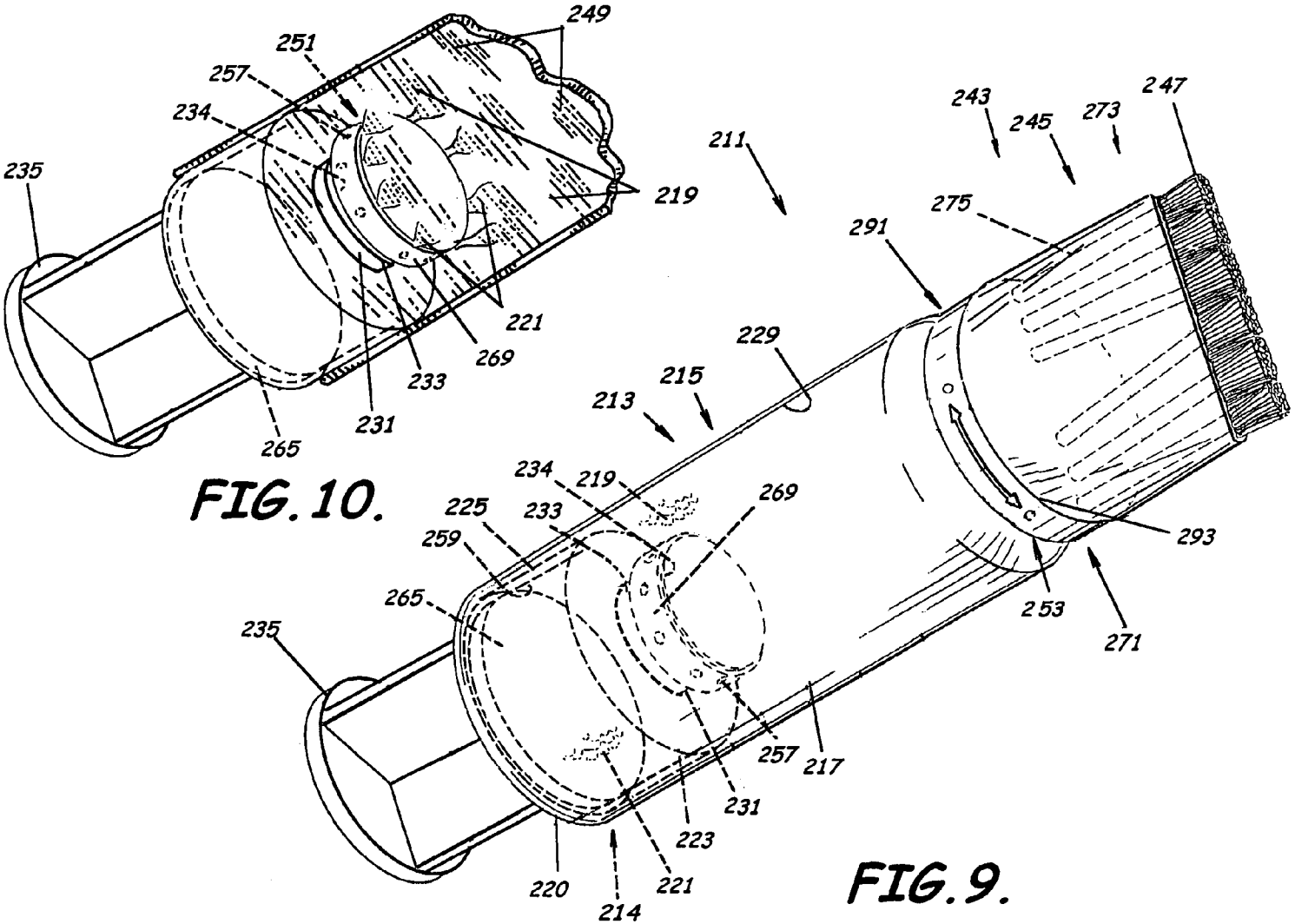
FIG. 9 is perspective view of an apparatus for coloring hair, according to an embodiment of the present invention.
FIG. 10 is an enlarged fragmentary perspective view of an apparatus for coloring hair, according to an embodiment of the present invention.

In another embodiment of the present invention, as perhaps best shown in FIGS. 9 and 10, a hair coloring apparatus 211, similar to apparatus 21 illustrated in FIG. 2, instead includes a flexible hair color mixture dispensing container 213 having a two-stage interior recess 214. More specifically, the hair coloring apparatus 211 includes the hair color mixture dispensing container 213 having an inner dispensing container chamber 217 formed in a medial body portion 215 of the dispensing container 213 and having a first hair coloring solution 219 positioned therein. The hair color mixture dispensing container 213 also has the two-stage interior recess 214 inwardly extending from a proximal body end portion 220 into the medial body portion 215 and having a second hair coloring solution 221 positioned therein. Note, the various embodiments of the plunger 235 and hair color mixture dispenser 243 of hair coloring apparatus 211 are sufficiently similar to that of plunger 35 and hair color mixture dispenser 43 of hair coloring apparatus 21, described above, that for brevity purposes, and as understood by those skilled in the art, a separate detailed description should not be necessary. The two-stage interior recess 214 of hair coloring apparatus 211 is sufficiently different from that of interior recess 31 of hair coloring apparatus 21 to warrant detailed discussion.

A first or main stage interior recess 223 of the two-stage interior recess 214 has outer surface regions 225 with an outer circumference sized substantially the same as an inner circumference of inner surface regions 229 of the hair color mixture dispensing container 213 adjacent the outer surface regions 225 of the first stage interior recess 223. The outer surface regions 225 can further be laminated or otherwise connected to the inner surface regions 229 adjacent the outer surface regions 225, according to various methods known by those skilled in the art. Additionally, either a section of the outer surface regions 225 or inner surface regions 229 can include an attachment flange or seal (not shown) laminated or otherwise affixed between the outer surface regions 225 and inner surface regions 229 of flexible hair color mixture dispensing container 213. Note, according to embodiments of the present invention, portions of the outer surface regions 225 may also extend out from within the inner dispensing container chamber 217 of the hair color mixture dispensing container 213, through the proximal body end portion 220, and still remain within the scope of the present invention.

A second or auxiliary stage interior recess 231 of the two-stage interior recess 214, however, has outer surface regions 233 with a circumference substantially smaller than the outer circumference of the outer surface region 225 of the first stage interior recess 223. Advantageously, providing a first stage interior recess 223 with outer surface regions 225 having an outer circumference sized substantially the same as an inner circumference of the inner surface regions 229 of the hair color mixture dispensing container 213 helps minimize the depth of the two-stage interior recess 214 for a given amount of second hair coloring solution 221 and thus helps maximize the flexible surface area of the medial body portion 215 squeezed by the user to extrude a hair coloring mixture 249. Also, providing a second stage interior recess 231 with outer surface regions 233 having an outer circumference substantially smaller than the outer circumference of the outer surface regions 225 of the first stage interior recess 223 helps minimize the costs associated with selecting and forming an appropriate valve such as valve 251 to allow mixing of the first and second hair coloring solutions 219, 221, described below.

At least one opening 257, but preferably a plurality of recess openings 257, is formed in the second stage interior recess 231 and extend from interior surface regions 234 of the second stage interior recess 231 through outer surface regions 233 of the second stage interior recess 231 and into the inner dispensing container chamber 217. A flexible valve recess opening cover 269 can be positioned over the at least one recess opening 257 to close the at least one recess opening 257 formed in the second stage interior recess 231. The flexible valve recess opening cover 269 can serve to isolate the second hair coloring solution 221 positioned in the second stage interior recess 231 from the first hair coloring solution 219 positioned in the inner dispensing container chamber 217 so that the second hair coloring solution 221 is prevented from readily flowing from the second stage interior recess 231 into the inner dispensing container chamber 217.

A plunger 235, substantially similar to plunger 35 of apparatus 21, described above, can be, and preferably is, pre-positioned in the first stage interior recess 223 adjacent the proximal body end portion 220 of the hair color mixture dispensing container 213. When so positioned, the plunger 235 has a distal plunger end portion 265 positioned in the first stage interior recess 223 such that it is adjacent and in contact with the second hair coloring solution 221. The plunger 235 is adapted to respond to the user such that pressure on the plunger 235 induced by a user opens the flexible valve recess opening cover 269 to allow the first and second hair coloring solutions 219, 221, to mix in the inner dispensing container chamber 217. The second hair coloring solution 221 passes from within the second stage interior recess 231 through the at least one recess opening 257 to thereby form a hair color mixture 249 within the inner dispensing container chamber 217.

Similar to the medial body portion 25 of apparatus 21, the medial body portion 215 of the container 213 includes a flexible material, as understood by those skilled in the art, which can include various forms of plastics and flexible metals. Implementation with a flexible material allows a user to squeeze the medial body portion 215 of the container 213 to extrude hair color mixture 249 onto the hair of a user by passage of the hair color mixture 249 from within the inner container chamber 217. The first stage interior recess 223 can include a semi-rigid or rigid material to support the plunger 235. Like plunger 35, the plunger 235 is configured to fit closely and in sliding abutment with the interior recess surface regions 259 of the first stage interior recess 225 to further substantially prevent incidental extrusion of the second hair coloring solution 219 around the distal plunger end portion 265 of the plunger 235, especially during the application of pressure to the second hair coloring solution 229 with the plunger 235.

In an embodiment of the present invention, the at least one recess opening 257 can include a plurality of recess openings 257. In such configuration, the flexible valve recess opening cover 269 can be further positioned in a surrounding relationship over the plurality of recess openings 257, as illustrated, to close the plurality of recess openings 257 formed in the second stage interior recess 231. The flexible valve recess opening cover 269 can be adapted to respond to positive pressure applied to the inner recess 231 by the plunger 235 to thereby expand the valve recess cover 269 to uncover the plurality of recess openings 257 to allow the second hair coloring solution 221 to mix with the first hair coloring solution 219 in the inner container chamber 217. Correspondingly, the flexible valve recess opening cover 269 can be adapted to respond to a release of the positive pressure on the plunger 235 induced by the user to thereby allow the flexible valve recess opening cover 269 to contract to thereby prevent the hair color mixture from back-flowing from within the inner dispensing container chamber 217 and into the second stage interior recess 231. This described configuration can provide vacuum retention of the plunger 231 and prevent inadvertent extrusion of the hair color mixture through the second stage interior recess 231.

The dispensing container 213 can include additional provisions for preventing premature mixing of the first and second hair coloring solutions 219, 223. A medial body compression clasp, such as clasp 68 illustrated in FIG. 6, can be positioned in a surrounding relationship to a section of the medial body portion 215 of the dispensing container 213. The medial body compression clasp can compress the flexible material of the medial body portion 215 of the dispensing container 213, to thereby regulate the internal volume of the inner dispensing container chamber 217. This prevents self-expansion of the medial body portion 215 of the dispensing container 213. In some embodiments of valve cover 269, inadvertent expansion of the medial body portion 215 can result in a vacuum which can tend to draw the second hair coloring solution 221 through the recess openings 257 and into the inner dispensing container chamber 217. Additionally, the plunger 235 can include a plunger release, such as one similar to pin 36 illustrated in FIG. 6, to prevent inadvertent extrusion of the second hair coloring solution 221 into the inner chamber 217. The plunger release need not, however, be a pin in the normal sense. Though preferably in the form of a cotter pin or breakaway peg, the plunger release can also be in the form of a removable collar or breakaway band at least partially surrounding the elongated neck of plunger 235.

The hair coloring apparatus 211 also includes a hair color mixture dispenser 243 connected to an open distal body end portion 253 of the dispensing container 213 to dispense hair color mixture, therefrom. The hair color mixture dispenser 243 can include a brush applicator 245 such as one similar to the brush applicator 45, illustrated in FIG. 4, and thus shall not be illustrated in detail. The brush applicator 245 can have a proximal brush applicator end 271 including a proximal lengthwise extent and a proximal widthwise extent, and a distal brush applicator end 273 including a distal lengthwise extent and a distal widthwise extent. The distal widthwise extent can be substantially shorter than the proximal widthwise extent to concentrate the dispensing of the hair color mixture.

A plurality of hair color mixture extrusion channels 275 can be positioned between the proximal brush applicator end 271 and the distal brush applicator end 273. The brush applicator also includes a plurality of flexible bristles 247 associated with the distal brush applicator end 273. Each of the plurality of flexible bristles 247 can be positioned along the distal lengthwise extent of the distal brush applicator end 273 and can be positioned adjacent at least one of the plurality of hair color mixture extrusion channels 275 to provide substantially uniform lengthwise distribution of the hair color mixture. Each of the plurality of flexible bristles 247 can further be positioned in a surrounding relationship to at least one of the plurality of hair color mixture extrusion channels 275 to provide concentrated wetting of each of the plurality of flexible bristles 247 positioned therewith. This positioning can help provide substantially uniform lengthwise dispersion of the dispensed hair color mixture to the hair of the user. To this end, the plurality of hair color mixture extrusion channels 275 can also be substantially unobstructed in order to provide an increased flow of hair color mixture to the plurality of flexible bristles 247. Additionally, to provide for increased uniformity and ease of dispensing, the flexible bristles 247 are preferably flexible plastic bristles which have been found to function well in both retaining the hair color mixture within the flexible bristles 247 and releasing the mixture onto the hair of the user during application of the hair color mixture.

The hair color mixture dispenser 243 can include an extrusion channel closing valve 291. The extrusion channel closing valve 291 can be positioned adjacent the open distal body end portion 253 of the container and the proximal brush applicator end 271 of the brush applicator 243 to close the hair color mixture extrusion channels 275 so that the hair color mixture within the inner container chamber 217 is prevented from flowing into the plurality of hair color mixture extrusion channels 275. Suitable valves of this type are well known to those skilled in the art, however, in a preferred configuration, the extrusion channel closing valve 291 is similar to that illustrated in FIG. 4 and therefore shall not be illustrated in detail. The extrusion channel closing valve 291 can include a non-removable rotatable closure cap 293 connected between the open distal body end portion 253 of the container 213 and the proximal brush applicator end 271 of the brush applicator 243. The rotatable closure cap 293 can further be integral with the proximal brush applicator end 271. Regardless, the rotatable closure cap 293 can have a plurality of rotatable closure cap openings (not shown) in fluid communication with a corresponding plurality of the hair color mixture extrusion channels 275. The function is similar to that described above with respect to brush applicator 45 such that rotating the rotatable closure cap 293 in a first (open) direction will allow the hair color mixture to flow through the plurality of rotatable closure cap openings and rotating the rotatable closure cap 293 in a second (closed) direction substantially will prevent the hair color mixture from flowing through the plurality of rotatable closure cap openings.

Figure 7:
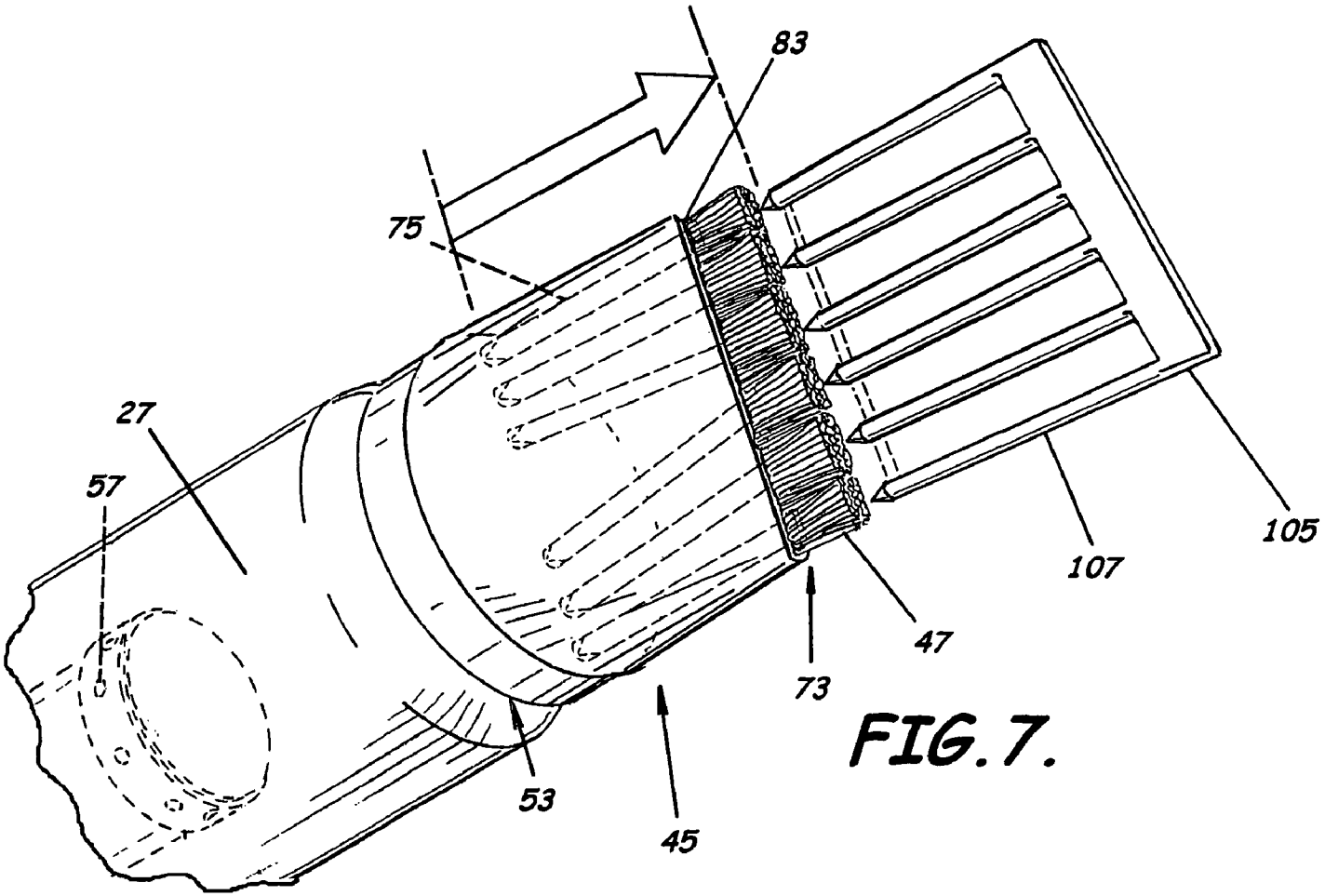
FIG. 7 is an enlarged fragmentary perspective view of an apparatus for coloring hair, according to an embodiment of the present invention.

Alternatively, instead of an extrusion channel closing valve in the form of a rotatable valve, the hair color mixture dispenser 243 can instead include a multi-prong closure cap, similar to the multi-prong closure cap 105 illustrated in FIG. 7, positioned adjacent the distal brush applicator 273 end. The multi-prong closure cap includes a plurality of teeth, each sealingly positioned within one of the plurality of hair color mixture extrusion channels 275 to selectively close the hair color mixture extrusion channels 275. In this fashion, the hair color mixture within the inner container chamber 217 is prevented from flowing out of the plurality of hair color mixture extrusion channels 275. Additionally, other extrusion channel closing means, as known by those skilled in the art, are within the scope of the present invention.

Figure 5:
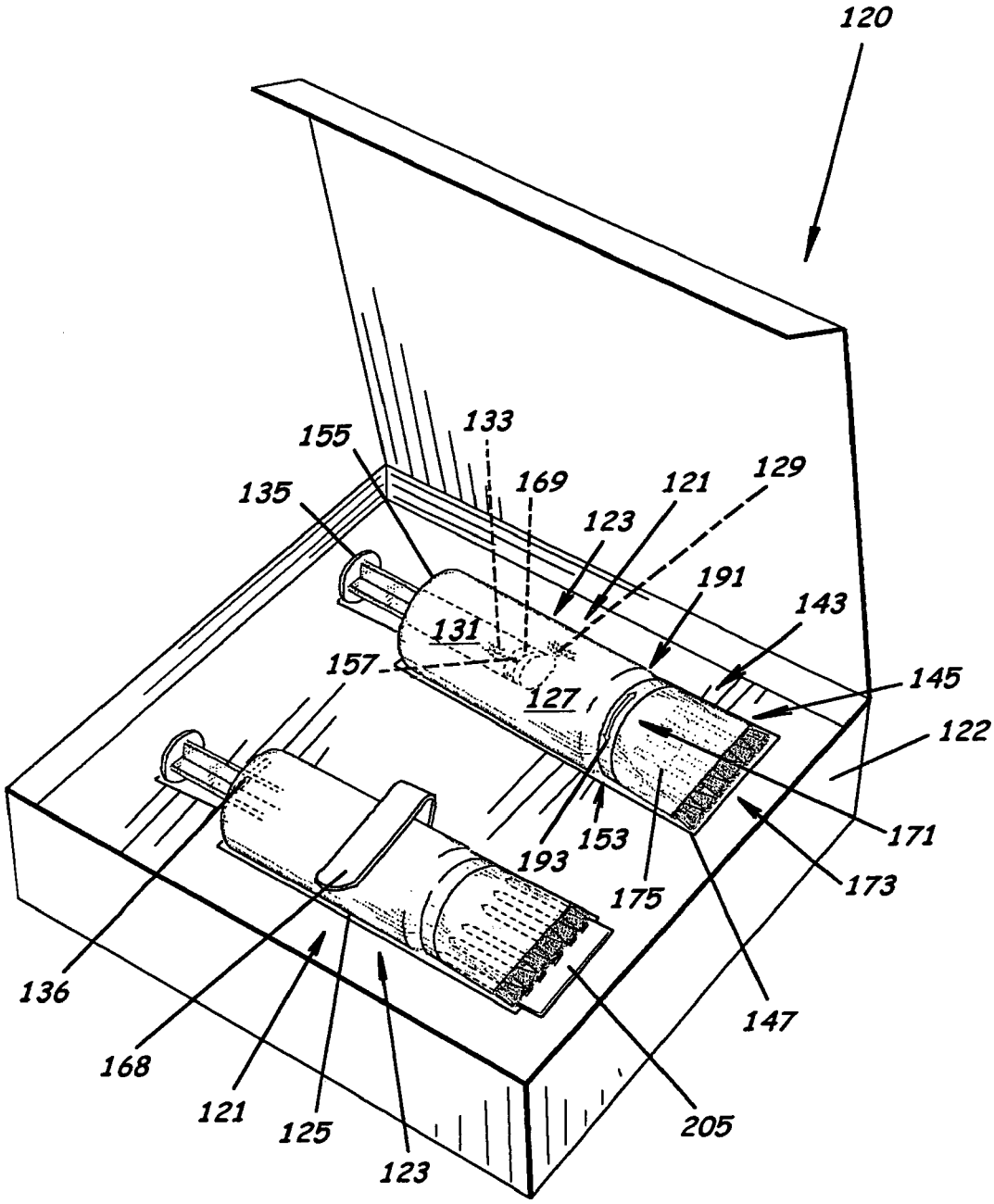
FIG. 5 is a perspective view of a kit, according to an embodiment of the present invention.

The present invention also advantageously provides a kit 120 for coloring hair. As shown in FIG. 5, the kit 120 includes a kit container 122 and a hair color mixture dispensing container 123 positioned within the kit container 122. The hair color mixture dispensing container 123 includes an inner dispensing container chamber 127 formed in a medial body portion 125 of the dispensing container 123. A first hair coloring solution 129 can be pre-positioned therein, or alternatively can be included in the kit container 122 in a separate package or container (not shown) for loading into the inner dispensing container chamber 127 by the user. The hair color mixture dispensing container 123 also includes an interior recess 131 inwardly extending from a proximal body end portion 155 into the medial body portion 125. A second hair coloring solution 133 can be pre-positioned therein, or also alternatively can be included in the kit container 122 in a separate package or container (not shown) for loading into the interior recess 131 by the user.

At least one but preferably a plurality of recess openings 157 are formed in the interior recess 131 and extend from interior recess surface regions of the interior recess 131 through outer recess surface regions of the interior recess 131 and into the inner dispensing container chamber 127. A flexible valve recess opening cover 169 can be positioned over the at least one recess opening 157 to close the at least one recess opening 157 formed in the interior recess 131. The flexible valve recess opening cover 169 can serve to isolate the second hair coloring solution 133 when positioned in the interior recess 131 from the first hair coloring solution 129 when positioned in the inner dispensing container chamber 127 so that the second hair coloring solution 133 is prevented from readily flowing from the interior recess 131 into the inner dispensing container chamber 127.

A plunger 135 can also be positioned within the kit container 122. The plunger 135 can be, and preferably is, pre-positioned in the interior recess 131 adjacent the proximal body end portion 155 of the hair color mixture dispensing container 123. When so positioned, the plunger 135 has a distal plunger end portion positioned in the interior recess 131 such that it is adjacent and in contact with the second hair coloring solution 133. The plunger 135 is adapted to respond to the user such that pressure on the plunger 135 induced by a user opens the flexible valve recess opening cover 169 to allow the first and second hair coloring solutions 129, 133, to mix in the inner dispensing container chamber 127. The second hair coloring solution 133 passes from within the interior recess 131 through the at least one recess opening 157 to thereby form a hair color mixture within the inner dispensing container chamber 127.

In an embodiment of the present invention, the at least one recess opening 157 can include a plurality of recess openings 157. In such configuration, the flexible valve recess opening cover 169 can be further positioned in a surrounding relationship over the plurality of recess openings 157, as illustrated, to close the plurality of recess openings 157 formed in the interior recess 131. The flexible valve recess opening cover 169 can be adapted to respond to positive pressure applied to the inner recess 131 by the plunger 135 to thereby expand the valve recess cover 169 to uncover the plurality of recess openings 157 to allow the second hair coloring solution 133 to mix with the first hair coloring solution 129 in the inner container chamber 127. Correspondingly, the flexible valve recess opening cover 169 can be adapted to respond to a release of the positive pressure on the plunger 135 induced by the user to thereby allow the flexible valve recess opening cover 169 to contract to thereby prevent the hair color mixture from back-flowing from within the inner dispensing container chamber 127 and into the interior recess 131. This described configuration can provide vacuum retention of the plunger 131 and prevent inadvertent extrusion of the hair color mixture through the interior recess 131.

The dispensing container 123 can include additional provisions for preventing premature mixing of the first and second hair coloring solutions 129, 133. A medial body compression clasp 168 can be positioned in a surrounding relationship to a section of the medial body portion 125 of the dispensing container 123. The medial body compression clasp 168 can compress deformable flexible material of the medial body portion 125 of the dispensing container 123, to thereby regulate the internal volume of the inner dispensing container chamber 127. This prevents self-expansion of the medial body portion 15 of the dispensing container 123. In some embodiments of valve cover 169, inadvertent expansion of the medial body portion 125 can result in a vacuum which can tend to draw the second hair coloring solution 133 through the recess openings 157 and into the inner dispensing container chamber 127. Additionally, the plunger 135 can include a plunger release to prevent inadvertent extrusion of the second hair coloring solution 133 into the inner chamber 127. The plunger release, illustrated as pin 136, need not, however, be a pin in the normal sense. Though preferably in the form of a cotter pin or breakaway peg, the plunger release can also be in the form of a removable collar or breakaway band at least partially surrounding the elongated neck of plunger 135.

The kit 120 also includes a hair color mixture dispenser 143 positioned in the kit container 122 and preferably connected to an open distal body end portion 153 of the dispensing container 123 to dispense hair color mixture, therefrom. Though the hair color mixture dispenser 123 can be alternatively positioned individually in the kit container 122, it has been found that the hair color mixture dispenser 143 should be either integral with the hair color mixture dispensing container 123 or at least non-removable without causing destruction to either the hair color mixture dispenser 143 or hair color mixture dispensing container 123. Providing the hair color dispenser 143 in a non-removable form helps prevent inadvertent spilling or discharge of either the first hair coloring solution 129 or the hair color mixture, once formed.

The hair color mixture dispenser 143 can include a brush applicator 145 such as one similar to the brush applicator 45, illustrated in FIG. 4, and thus shall not be illustrated in detail. The brush applicator 145 can have a proximal brush applicator end 171 including a proximal lengthwise extent and a proximal widthwise extent, and a distal brush applicator end 173 including a distal lengthwise extent and a distal widthwise extent. The distal widthwise extent can be substantially shorter than the proximal widthwise extent to concentrate the dispensing of the hair color mixture.

A plurality of hair color mixture extrusion channels 175 can be positioned between the proximal brush applicator end 171 and the distal brush applicator end 173. The brush applicator also includes a plurality of flexible bristles 147 associated with the distal brush applicator end 173. Each of the plurality of flexible bristles 147 can be positioned along the distal lengthwise extent of the distal brush applicator end 173 and can be positioned adjacent at least one of the plurality of hair color mixture extrusion channels 175 to provide substantially uniform lengthwise distribution of the hair color mixture. Each of the plurality of flexible bristles 147 can further be positioned in a surrounding relationship to at least one of the plurality of hair color mixture extrusion channels 175 to provide concentrated wetting of each of the plurality of flexible bristles 147 positioned therewith. This positioning can help provide substantially uniform lengthwise dispersion of the dispensed hair color mixture to the hair of the user. To this end, the plurality of hair color mixture extrusion channels 175 can also be substantially unobstructed in order to provide an increased flow of hair color mixture to the plurality of flexible bristles 147. Additionally, to provide for increased uniformity and ease of dispensing, the flexible bristles 147 are preferably flexible plastic bristles which have been found to function well in both retaining the hair color mixture within the flexible bristles 147 and releasing the mixture onto the hair of the user during application of the hair color mixture.

The hair color mixture dispenser 143 can include an extrusion channel closing valve 191. The extrusion channel closing valve 191 can be positioned adjacent the open distal body end portion 153 of the container and the proximal brush applicator end 171 of the brush applicator 143 to close the hair color mixture extrusion channels 175 so that the hair color mixture within the inner container chamber 27 is prevented from flowing into the plurality of hair color mixture extrusion channels 175. Suitable valves of this type are well known to those skilled in the art, however, in a preferred configuration, the extrusion channel closing valve 191 is similar to that illustrated in FIG. 4 and therefore shall not be illustrated in detail. The extrusion channel closing valve 191 can include a non-removable rotatable closure cap 193 connected between the open distal body end portion 153 of the container 123 and the proximal brush applicator end 171 of the brush applicator 143. The rotatable closure cap 193 can further be integral with the proximal brush applicator end 171. Regardless, the rotatable closure cap 193 can have a plurality of rotatable closure cap openings (not shown) in fluid communication with a corresponding plurality of the hair color mixture extrusion channels 175. The function is similar to that described above with respect to brush applicator 45 such that rotating the rotatable closure cap 193 in a first (open) direction will allow the hair color mixture to flow through the plurality of rotatable closure cap openings and rotating the rotatable closure cap 193 in a second (closed) direction substantially will prevent the hair color mixture from flowing through the plurality of rotatable closure cap openings.

Alternatively, instead of an extrusion channel closing valve in the form of a rotatable valve, the hair color mixture dispenser 143 can instead include a multi-prong closure cap 205 positioned adjacent the distal brush applicator 173 end. The multi-prong closure cap 205 includes a plurality of teeth, each sealingly positioned within one of the plurality of hair color mixture extrusion channels 175 to selectively close the hair color mixture extrusion channels 175. In this fashion, the hair color mixture within the inner container chamber 127 is prevented from flowing out of the plurality of hair color mixture extrusion channels 175. Additionally, other extrusion channel closing means, as known by those skilled in the art, are within the scope of the present invention.

As shown in FIGS. 1–4, 6–8, embodiments of the present invention also include methods of using an apparatus for coloring hair, such as, for example, apparatus 21. According to an embodiment of the present invention, as perhaps best shown in FIGS. 2 and 3, a method of using an apparatus 21 for coloring hair includes applying pressure against a hair coloring solution 33, such as, for example, a developing solution or developer, contained within an interior recess 31 of a hair coloring container 23. The interior recess 31 inwardly extends into an inner container chamber 27 of the container 23. The inner container chamber 27 of the container 23 also contains a hair coloring solution 29, such as, for example, actual hair coloring. As perhaps best shown in FIG. 3, the pressure applied against the hair coloring solution 33 in the interior recess 31 expands a flexible valve cover 69 positioned in a surrounding relationship over a plurality of recess openings 57 formed in the interior recess 31. The application of pressure against the hair color solution 33 can be through use of positive pressure on a plunger 35 induced by the user. The plunger 35 can have a distal plunger end portion 65 preferably pre-positioned in the mouth of the interior recess 31 adjacent the hair coloring solution 33.

The expansion of the flexible valve cover 69 results in uncovering the plurality of recess openings 57 to allow the hair coloring solutions 29, 33, to mix in the inner container chamber 27. The mixing of the hair coloring solutions 29, 33, results in the formation of a hair color mixture 49 positioned within the inner container chamber 27 and is accomplished as a result of the passage of the hair coloring solution 33 from within the interior recess 31 through the plurality of recess openings 57 and into the inner container chamber 27 containing the hair coloring solution 29. Releasing the application of pressure on the plunger 35, after forming the hair color mixture 49, causes the flexible valve cover 69 to contract and thus to re-cover the plurality of recess openings 57 to prevent the hair color mixture 49 from flowing from the inner container chamber 27 and into the interior recess 31. This functional structure helps prevent inadvertent removal of the plunger 35 and inadvertent extrusion of the hair coloring mixture 49 through the interior recess 31.

Figure 8:
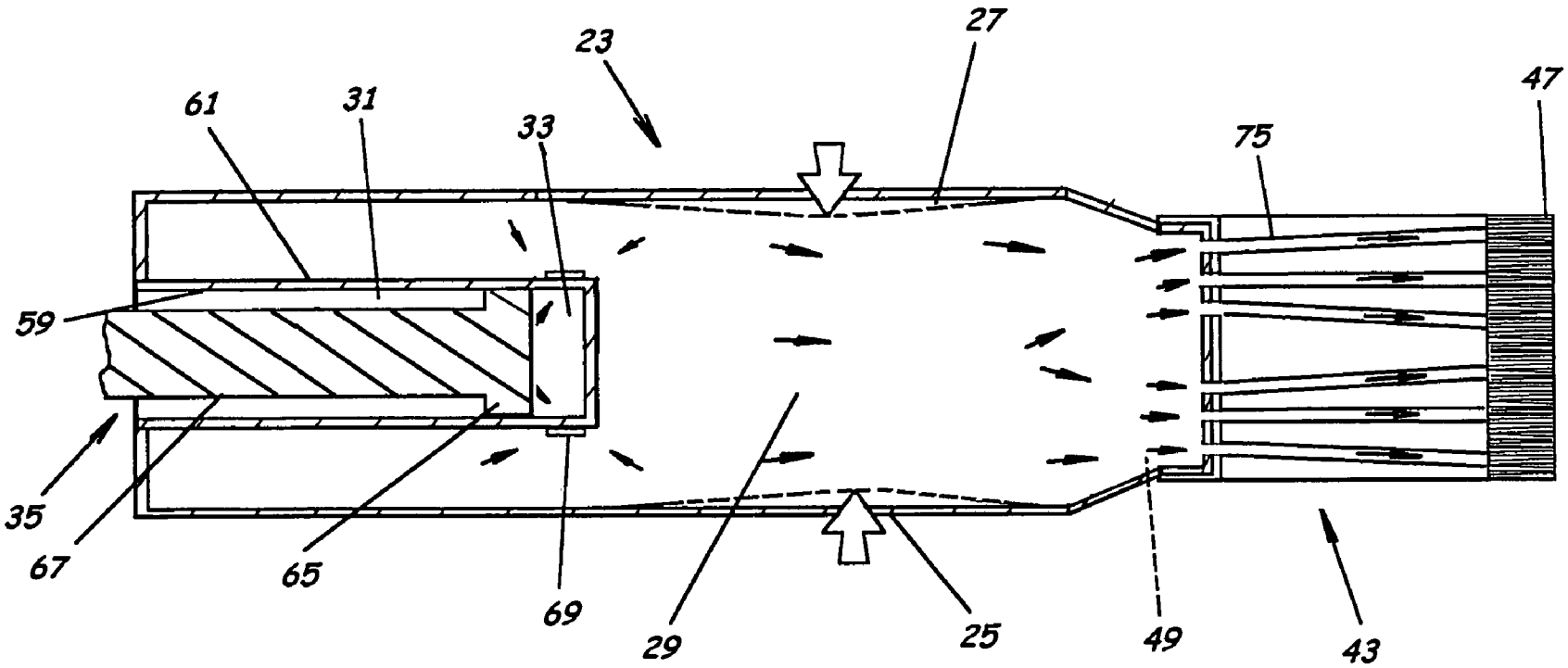
FIG. 8 is a fragmentary schematic view of an apparatus for coloring hair, according to an embodiment of the present invention.

As shown in FIGS. 1, 4, and 8, the method further includes dispensing the hair color mixture 49. As perhaps best shown in FIG. 4, in an embodiment of the present invention which includes a rotatable closure cap 93, after forming the hair color mixture 49, the user rotates the rotatable closure cap 93 to an open position O. As perhaps best shown in FIGS. 1 and 8, the user then squeezes a flexible medial body portion 25 of the container 23 to extrude the hair color mixture 49 onto the hair of the user. The extrusion is accomplished by passage of the hair color mixture 49 from within the inner container chamber 27 through a plurality of hair color mixture extrusion channels 75 and to a plurality of flexible bristles 47 adapted to be brushed through the hair of the user.

As shown in FIGS. 1, 4, and 7–8, in another example of a method of using an apparatus for coloring hair, such as apparatus 21, the method can include dispensing the hair color mixture 49 and applying the hair color mixture 49 to the hair of the user. As perhaps best shown in FIG. 7, the dispensing step can include dispensing a hair color mixture 49 onto the hair of a user by removing a multi-prong closure cap 105 positioned adjacent a distal brush applicator end 73 of a brush applicator 45 having a plurality of teeth 107 each sealingly positioned within one of a plurality of hair color mixture extrusion channels 75. As perhaps best shown in FIG. 1, user squeezes a flexible medial body portion 25 of a container 23 connected to the brush applicator 45 to extrude the hair color mixture 49 by passage of the hair color mixture 49 from within an inner container chamber 27 through a plurality of hair color mixture extrusion channels 75 and to a plurality of flexible bristles 47 positioned in a row-like arrangement along a distal lengthwise extent 83 of the distal brush applicator end 73.

Also as perhaps best shown in FIG. 1, the application step can include applying a substantially uniform lengthwise distribution of the hair color mixture 49 in a single stroke to a lengthwise area of a portion of the hair of the user by brushing the plurality of flexible bristles 47 against the hair while dispensing the hair coloring mixture 49.

Embodiments of the present invention also include business methods of providing a kit 120 for coloring hair. For example, according to an embodiment of the present invention, as shown in FIG. 5, an apparatus 121 for coloring hair, similar to apparatus 21, can be manufactured such that the apparatus 121 includes a single dispensing container 123 having a medial body portion with an inner container chamber 127 formed in the medial body portion for containing a first hair coloring solution 129 and an interior recess 131 for containing a second hair coloring solution 133.

The apparatus 121 further includes a plunger 135 positioned adjacent and in contact with the second hair coloring solution 133. The plunger 135 is adapted to be used for applying pressure to the second hair color solution 133 to mix the second hair coloring solution 133 into the first hair coloring solution 129 within the inner container chamber 127. A valve including a flexible valve cover 169 can be positioned within the inner container chamber 127 in a surrounding relationship over a plurality of recess openings 157 in the interior recess 131. The flexible valve cover 169 is responsive to a positive pressure on the plunger 135 induced by the user to allow passage of the second hair color solution 133, through the plurality of recess openings 169, to allow the second hair coloring solution 133 to mix with the first hair coloring solution 129 in the inner container chamber 127.

A hair color mixture dispenser 143 can be connected to the container 123 and can include a brush applicator 145 having a plurality of flexible bristles 147 for applying a hair coloring mixture onto the hair of the user. The flexible bristles 147 are positioned adjacent a distal brush applicator end 173 and a rotatable closure cap 193 is positioned adjacent a proximal brush applicator end 171 to allow passage of the hair color mixture from within the inner container chamber 127 of the container 123 to the plurality of flexible bristles 147. The plurality of flexible bristles 147 can be selected to be flexible plastic bristles. Although others are within the scope of the present invention, flexible plastic bristles have been found to provide optimum retention and eventual release of the hair color mixture. The hair color mixture dispenser 143 can be manufactured such that the rotatable closure cap 193 is of a type that is either non-removable or integral with the open distal body end portion 153. This design helps prevent inadvertent spillage or premature release of the hair color mixture.

After manufacture of the dispensing container 123, a medial body compression clasp 168 can be positioned in a surrounding relationship to a section of the medial body portion 125 of the dispensing container 123. The medial body compression clasp 168 can compress deformable flexible material of the medial body portion 125 of the dispensing container 123, to thereby regulate the internal volume of the inner dispensing container chamber 127. Additionally, the plunger 135 can include a plunger release, such as pin 136, to prevent inadvertent extrusion of the second hair coloring solution 133 into the inner chamber 127.

In an embodiment of the present invention, after manufacture, the apparatus 121 can be packaged as a combined unit in a single package or container 122 such that the user need only open the package, read any instructions, if so included, form the hair color mixture, and apply the hair color mixture onto the hair of the user. Similar to the methodology for forming the hair color mixture 49 with respect to apparatus 21 described and illustrated in detail with respect to FIGS. 2–4, the user generally needs only press or depress the plunger 135 inwardly to substantially its full extent to properly mix the first and second hair coloring solutions 129, 133. To dispense the now formed hair color mixture, the user generally need only rotate the rotatable closure cap 193 to allow passage of the hair color mixture from within the inner container chamber 127 of the container 123 to the plurality of clusters of flexible bristles 147 on the distal brush applicator end 173 of the brush applicator 145. The user can then squeeze outer surface regions of the medial body portion 125 of the container 123 to produce a flow of the hair color mixture to the plurality of flexible bristles 147 and thus, onto the hair of the user.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the attached claims. For example, although the methods of use were primarily described with respect to two of the embodiments of the apparatus for coloring hair, as a minimum the methods of use can be equally applied to each of the embodiments of the apparatus for coloring hair described in the foregoing detailed description. Also for example, although the kit was primarily described with respect to two of the embodiments of the apparatus for coloring hair, as a minimum, the kit container can contain either of the embodiments of the apparatus for coloring hair described in the foregoing detailed description.

That claimed is:

1. An apparatus for coloring hair, comprising:

a container including an open distal body end portion, a substantially closed proximal body end portion, a medial body portion connected to and extending between the open distal body end portion and the closed proximal body end portion, an inner container chamber formed in the medial body portion of the container to contain a first hair coloring solution therein, an interior recess inwardly extending from the proximal body end portion into the medial body portion to contain a second hair coloring solution therein, and a plurality of recess openings formed in the interior recess and extending from interior recess surface regions of the interior recess into the inner container chamber;

recess closing means positioned adjacent the plurality of recess openings to close the plurality of recess openings formed in the interior recess to thereby isolate the second hair coloring solution from the first hair coloring solution so that the second hair coloring solution when positioned in the interior recess is prevented from readily flowing from the interior recess into the inner container chamber;

a plunger having a distal plunger end portion positioned in the interior recess adjacent the second hair coloring solution when positioned therein so that positive pressure on the plunger induced by a user opens the recess closing means to allow the first and second hair coloring solutions to mix in the inner container chamber to thereby form a hair color mixture within the inner container chamber by passage of the second hair coloring solution from within the interior recess through the plurality of recess openings; and a hair color mixture dispenser connected to the open distal body end portion of the container to dispense hair color mixture therefrom, the hair color mixture dispenser including:

a brush applicator having a proximal brush applicator end, a distal brush applicator end, a plurality of hair color mixture extrusion channels positioned between the proximal brush applicator end and the distal brush applicator end, and a plurality of flexible bristles associated with the distal brush applicator end and positioned along a length of the distal brush applicator end and adjacent at least one of the plurality of hair color mixture extrusion channels, and extrusion channel closing means positioned adjacent the open distal body end portion of the container and the proximal brush applicator end of the brush applicator to selectively close the hair color mixture extrusion channels so that the hair color mixture within the inner container chamber is prevented from flowing into the plurality of hair color mixture extrusion channels.

2. An apparatus of claim 1, wherein the interior recess further includes outer recess surface regions, wherein the plurality of recess openings formed in the interior recess extend through the outer recess surface regions of the interior recess, and wherein the recess closing means comprises a valve positioned adjacent the plurality of recess openings to close the plurality of recess openings.

3. An apparatus of claim 2, wherein the valve comprises a flexible valve cover positioned within the inner container chamber in a surrounding relationship over the plurality of recess openings and responsive to the positive pressure on the plunger induced by the user to thereby expand the flexible valve cover to uncover the plurality of recess openings to allow the second hair coloring solution to mix with the first hair coloring solution in the inner container chamber.

4. An apparatus of claim 2, wherein the valve is responsive to a release of the positive pressure on the plunger induced by the user to thereby close the valve to prevent the hair color mixture from flowing from the inner container chamber and into the interior recess.

5. An apparatus of claim 1, wherein the interior recess comprises a main interior recess including outer main surface regions having an outer main circumference and an auxiliary interior recess including outer auxiliary surface regions having an outer auxiliary circumference substantially smaller than the outer main circumference of the outer main surface regions, and wherein the plurality of recess openings are formed in the auxiliary interior recess and extend from auxiliary interior recess surface regions of the auxiliary interior recess into the inner container chamber.

6. An apparatus of claim 5, wherein the outer main circumference of outer main surface regions of the main interior recess is sized substantially the same as an inner circumference of inner surface regions of the container adjacent the outer main surface regions of the main interior recess to thereby reduce a depth of the interior recess.

7. An apparatus of claim 1, wherein the extrusion channel closing means includes:

a rotatable closure cap connected between the open distal body end portion of the container and the proximal brush applicator end of the brush applicator and having a plurality of rotatable closure cap openings in fluid communication with a corresponding plurality of the hair color mixture extrusion channels, wherein rotating the closure cap in a first direction allows the hair color mixture to flow through the plurality of rotatable closure cap openings and rotating the rotatable closure cap in a second direction substantially prevents the hair color mixture from flowing through the plurality of rotatable closure cap openings; and a membrane positioned between the open distal body end portion of the container and the rotatable closure cap and having a plurality of membrane openings in fluid communication with the inner container chamber and the rotatable closure cap, at least one of the plurality of membrane openings substantially axially aligned and in fluid communication with at least one of the plurality of closure cap openings when the closure cap is rotated in the first direction to allow the hair color mixture to flow through the plurality of rotatable closure cap openings, and each of the plurality of membrane openings substantially nonaligned with each of the plurality of closure cap openings when the closure cap is rotated in the second direction to substantially prevent the fluid from flowing through the plurality of rotatable closure cap openings.

8. An apparatus of claim 1, wherein the proximal brush applicator end includes a proximal lengthwise extent and a proximal widthwise extent, wherein the distal brush applicator end includes a distal lengthwise extent and a distal widthwise extent, wherein the distal widthwise extent is substantially shorter than the proximal widthwise extent, wherein each of the plurality of hair color mixture extrusion channels is substantially unobstructed and is positioned spaced apart in a single row along the distal lengthwise extent of the distal brush applicator end to provide substantially uniform lengthwise distribution of the hair color mixture, and wherein each of the plurality of flexible bristles is positioned in a surrounding relationship to at least one of the plurality of hair color mixture extrusion channels to provide concentrated wetting of each of the plurality of flexible bristles positioned therewith to thereby further provide substantially uniform lengthwise dispersion of the dispensed hair color mixture to a lengthwise area of hair of the user.

9. An apparatus of claim 1, wherein the medial body portion of the container comprises a deformable flexible material to thereby allow the user to squeeze the medial body portion of the container to extrude the hair color mixture onto the hair of the user by passage of the hair color mixture from within the inner container chamber through the plurality of hair color mixture extrusion channels when the extrusion channel closing means is open, wherein the interior recess of the medial body portion of the container comprises a rigid material, and wherein the plunger is configured to fit closely and in sliding abutment with the interior recess surface regions of the interior recess to substantially prevent incidental extrusion of the second hair coloring solution around the distal plunger end portion of the plunger.

10. An apparatus of claim 9, further comprising a medial body compression clasp positioned in a surrounding relationship to a section of the medial body portion of the container to compress the deformable flexible material to thereby regulate an internal volume of the container to prevent self-expansion of the medial body portion of the container.

11. An apparatus of claim 1, wherein the hair color mixture dispenser is relatively permanently affixed to the open distal body end portion of the container to prevent separation of the hair coloring dispenser from the open distal body end portion of the container by the user to thereby prevent spilling of the hair color mixture.

12. An apparatus of claim 1, wherein the proximal brush applicator end of the hair color mixture dispenser is integral with the open distal body end portion of the container to prevent opening of the container by the user to thereby prevent spilling of the hair color mixture.

13. An apparatus for coloring hair, comprising:

a container including an inner container chamber formed in a medial body portion of the container to contain a first hair coloring solution therein, an interior recess inwardly extending from a proximal body end portion into the medial body portion to contain a second hair coloring solution therein and having outer recess surface regions, and at least one recess opening formed in the interior recess and extending from interior recess surface regions of the interior recess through the outer recess surface regions of the interior recess and into the inner container chamber;

a valve positioned adjacent the at least one recess opening to close the at least one recess opening formed in the interior recess to thereby isolate the second hair coloring solution from the first hair coloring solution so that the second hair coloring solution when positioned in the interior recess is prevented from readily flowing from the interior recess into the inner container chamber; and a hair color mixture dispenser connected to an open distal body end portion of the container to dispense hair color mixture therefrom, the hair color mixture dispenser including:

a brush applicator having a proximal brush applicator end, a distal brush applicator end, a plurality of hair color mixture extrusion channels positioned between the proximal brush applicator end and the distal brush applicator end, and a plurality of flexible bristles associated with the distal brush applicator end, positioned along a length of the distal brush applicator end, and positioned adjacent at least one of the plurality of hair color mixture extrusion channels, and an extrusion channel closing valve connected between the open distal body end portion of the container and the proximal brush applicator end of the brush applicator to selectively close the hair color mixture extrusion channels so that the hair color mixture within the inner container chamber is prevented from flowing into the plurality of hair color mixture extrusion channels, the extrusion channel closing valve including a rotatable closure cap having a plurality of rotatable closure cap openings in fluid communication with a corresponding plurality of the hair color mixture extrusion channels, and wherein rotating the closure cap in a first direction allows the hair color mixture to flow through the plurality of rotatable closure cap openings and rotating the rotatable closure cap in a second direction substantially prevents the hair color mixture from flowing through the plurality of rotatable closure cap openings.

14. An apparatus of claim 13, wherein the interior recess comprises a main interior recess including outer main surface regions having an outer main circumference and an auxiliary interior recess including outer auxiliary surface regions having an outer auxiliary circumference substantially smaller than the outer main circumference of the outer main surface regions, and wherein the at least one recess opening is formed in the auxiliary interior recess and extends from auxiliary interior recess surface regions of the auxiliary interior recess into the inner container chamber.

15. An apparatus of the claim 14, wherein the at least one recess opening includes a plurality of recess openings, wherein the valve includes a flexible valve cover positioned in the inner container chamber and positioned over the plurality of recess openings formed in the auxiliary interior recess to thereby isolate the second hair coloring solution when positioned in the interior recess from the first hair coloring solution when positioned in the inner container chamber so that the second hair coloring solution is prevented from readily flowing from the interior recess into the inner container chamber.

16. An apparatus of claim 15, further comprising a plunger having a distal plunger end portion positioned in the main interior recess adjacent the second hair coloring solution so that positive pressure on the plunger induced by a user expands the flexible valve cover to allow the first and second hair coloring solutions to mix in the inner container chamber to thereby form a hair color mixture within the inner container chamber by passage of the second hair coloring solution from within the main interior recess through the auxiliary interior recess and through the plurality of recess openings in the auxiliary interior recess.

17. An apparatus of claim 13, further comprising:

a plunger having a distal plunger end portion positioned in the interior recess adjacent the second hair coloring solution so that positive pressure on the plunger induced by a user opens the valve to allow the first and second hair coloring solutions to mix in the inner container chamber to thereby form a hair color mixture within the inner container chamber by passage of the second hair coloring solution from within the interior recess through the at least one recess opening.

18. An apparatus of claim 17, wherein the valve comprises a flexible valve cover positioned within the inner container chamber over the at least one recess opening and responsive to the positive pressure on the plunger induced by the user to thereby expand the flexible valve cover to uncover the at least one recess opening to allow the second hair coloring solution to mix with the first hair coloring solution in the inner container chamber, and wherein the flexible valve cover is responsive to a release of the positive pressure on the plunger induced by the user to thereby close the valve to prevent the hair color mixture from flowing from the inner container chamber and into the interior recess.

19. An apparatus of claim 17, wherein the valve is responsive to a release of the positive pressure on the plunger induced by the user to thereby close the valve to prevent the hair color mixture from flowing from the inner container chamber and into the interior recess and to prevent non-destructive removal of the plunger.

20. An apparatus of claim 17, wherein the at least one recess opening includes a plurality of recess openings, and wherein the plurality of recess openings formed in the interior recess extend through outer recess surface regions of the interior recess.

21. An apparatus of claim 17, wherein the medial body portion of the container comprises a deformable flexible material to thereby allow the user to squeeze the medial body portion of the container to extrude the hair color mixture onto hair of the user by passage of the hair color mixture from within the inner container chamber, wherein the interior recess of the medial body portion of the container comprises a rigid material to support the plunger, and wherein the plunger is configured to fit closely and in sliding abutment with the interior recess surface regions of the interior recess to substantially prevent incidental extrusion of the second hair coloring solution around the distal plunger end portion of the plunger.

22. An apparatus of claim 13, wherein the outer main circumference of outer main surface regions of the main interior recess is sized substantially the same as an inner circumference of inner surface regions of the container adjacent the outer main surface regions of the main interior recess to thereby reduce a depth of the interior recess.

23. An apparatus of claim 13, wherein the proximal brush applicator end includes a proximal lengthwise extent and a proximal widthwise extent, wherein the distal brush applicator end includes a distal lengthwise extent and a distal widthwise extent, wherein the distal widthwise extent is substantially shorter than the proximal widthwise extent, wherein each of the plurality of hair color mixture extrusion channels is positioned spaced apart in a single row along the distal lengthwise extent of the distal brush applicator end to provide substantially uniform lengthwise distribution of the hair color mixture, and wherein each of the plurality of hair color mixture extrusion channels adjacent the distal brush applicator end is substantially unobstructed.

24. An apparatus for coloring hair, comprising:

a container including an inner container chamber formed in a medial body portion of the container to contain a first hair coloring solution therein, an interior recess inwardly extending from a proximal body end portion into the medial body portion to contain a second hair coloring solution therein and having outer recess surface regions, and at least one recess opening formed in the interior recess and extending from interior recess surface regions of the interior recess through the outer recess surface regions of the interior recess and into the inner container chamber, the medial body portion of the container comprising a deformable flexible material to thereby allow the user to squeeze the medial body portion of the container to extrude the hair color mixture to hair of the user;

a valve positioned adjacent the at least one recess opening to close the at least one recess opening formed in the interior recess to thereby isolate the second hair coloring solution from the first hair coloring solution so that the second hair coloring solution when positioned in the interior recess is prevented from readily flowing from the interior recess into the inner container chamber;

a plunger having a distal plunger end portion positioned in the interior recess adjacent the second hair coloring solution so that positive pressure on the plunger induced by a user opens the valve to allow the first and second hair coloring solutions to mix in the inner container chamber to thereby form a hair color mixture within the inner container chamber by passage of the second hair coloring solution from within the interior recess through the at least one recess opening; and a medial body compression clasp positioned in a surrounding relationship to a section of the medial body portion of the container to compress the deformable flexible material of the medial body portion to thereby regulate an internal volume of the container to prevent self-expansion of the medial body portion of the container.

25. An apparatus for coloring hair, comprising:

a container including an inner container chamber formed in a medial body portion of the container to contain a first hair coloring solution therein, an interior recess inwardly extending from a proximal body end portion into the medial body portion to contain a second hair coloring solution therein and having outer recess surface regions, and at least one recess opening formed in the interior recess and extending from interior recess surface regions of the interior recess through the outer recess surface regions of the interior recess and into the inner container chamber;

a valve positioned adjacent the at least one recess opening to close the at least one recess opening formed in the interior recess to thereby isolate the second hair coloring solution from the first hair coloring solution so that the second hair coloring solution when positioned in the interior recess is prevented from readily flowing from the interior recess into the inner container chamber; and a hair color mixture dispenser connected to an open distal body end portion of the container to dispense hair color mixture therefrom, the hair color mixture dispenser including:

a brush applicator having a proximal brush applicator end, a distal brush applicator end, a plurality of hair color mixture extrusion channels positioned between the proximal brush applicator end and the distal brush applicator end, and a plurality of flexible bristles associated with the distal brush applicator end positioned along a length of the distal brush applicator end and positioned adjacent at least one of the plurality of hair color mixture extrusion channels, the proximal brush applicator end of the hair color mixture dispenser integral with the open distal body end portion of the container to prevent opening of the container by the user to thereby prevent spilling of the hair color mixture, an extrusion channel closing valve connected adjacent the distal brush applicator end of the brush applicator to selectively close the hair color mixture extrusion channels, and a multi-prong closure cap positioned adjacent the distal brush applicator end and having a plurality of teeth each sealingly positioned within one of the plurality of hair color mixture extrusion channels to selectively close the hair color mixture extrusion channels so that hair color mixture within the inner container chamber is prevented from flowing out of the plurality of hair color mixture extrusion channels.

26. A disposable container for coloring hair, comprising:

an inner container chamber formed in a medial body portion of the container to contain a first hair coloring solution therein, the medial body portion of the container comprising a deformable flexible material to thereby allow a user to squeeze the medial body portion of the container to extrude the hair color mixture onto hair of a user by passage of the hair color mixture from within the inner container chamber;

an interior recess inwardly extending from a proximal body end portion of the container into the medial body portion to contain a second hair coloring solution therein, the interior recess comprising a rigid material to support housing a plunger and having outer recess surface regions;

at least one recess opening formed in the interior recess and extending from interior recess surface regions of the interior recess through outer recess surface regions of the interior recess and into the inner container chamber; and a medial body compression clasp positioned in a surrounding relationship to a section of the medial body portion of the container to compress the deformable flexible material of the medial body portion to thereby regulate an internal volume of the container to prevent self-expansion of the medial body portion of the container.

27. A disposable container of claim 26, further comprising a flexible valve cover positioned in the inner container chamber and positioned over the at least one recess opening formed in the interior recess to thereby isolate the second hair coloring solution when positioned in the interior recess from the first hair coloring solution when positioned in the inner container chamber so that the second hair coloring solution is prevented from readily flowing from the interior recess into the inner container chamber.

28. A disposable container of claim 27, further comprising:

a plunger having a distal plunger end portion positioned in the interior recess adjacent the second hair coloring solution so that positive pressure on the plunger induced by a user expands the flexible valve cover to allow the first and second hair coloring solutions to mix in the inner container chamber to thereby form a hair color mixture within the inner container chamber by passage of the second hair coloring solution from within the interior recess through the at least one recess opening.

29. A disposable container of claim 26, wherein the interior recess further comprises a main interior recess including outer main surface regions having an outer main circumference and an auxiliary interior recess including outer auxiliary surface regions having an outer auxiliary circumference substantially smaller than the outer main circumference of the outer main surface regions, and wherein the at least one recess opening is formed in the auxiliary interior recess and extends from auxiliary interior recess surface regions through the outer auxiliary surface regions of the auxiliary interior recess into the inner container chamber.

30. A disposable container of claim 29, further comprising:

a flexible valve cover positioned in the inner container chamber and positioned over the at least one recess opening formed in the auxiliary interior recess to thereby isolate the second hair coloring solution when positioned in the interior recess from the first hair coloring solution when positioned in the inner container chamber so that the second hair coloring solution is prevented from readily flowing from the interior recess into the inner container chamber; and a plunger having a distal plunger end portion positioned in the main interior recess adjacent the second hair coloring solution so that positive pressure on the plunger induced by a user expands the flexible valve cover to allow the first and second hair coloring solutions to mix in the inner container chamber to thereby form a hair color mixture within the inner container chamber by passage of the second hair coloring solution from within the main interior recess through the auxiliary interior recess and through the plurality of recess openings in the auxiliary interior recess.

31. A disposable container of claim 28, wherein the at least one recess opening includes a plurality of recess openings, wherein the flexible valve cover is positioned in a surrounding relationship over the plurality of recess openings and responsive to the positive pressure on the plunger induced by the user to thereby expand the flexible valve cover to uncover the plurality of recess openings to allow the second hair coloring solution to mix with the first hair coloring solution in the inner container chamber.

32. A disposable container of claim 28, wherein the flexible valve cover is responsive to a release of the positive pressure on the plunger induced by the user to thereby close the flexible valve cover to prevent the hair color mixture from flowing from the inner container chamber and into the interior recess and to prevent non-destructive removal of the plunger.

33. A disposable container of claim 29, wherein the outer main circumference of outer main surface regions of the main interior recess is sized substantially the same as an inner circumference of inner surface regions of the container adjacent the outer main surface regions of the main interior recess to thereby reduce a depth of the interior recess.

34. A disposable container of claim 28, wherein the plunger further comprises a plunger release positioned to prevent the plunger from inadvertent travel within the interior recess to thereby prevent unintentional mixing of the first and second hair coloring solutions.

35. A kit for coloring hair, comprising:

a kit container;

a hair color mixture dispensing container positioned within the kit container including:

an inner dispensing container chamber formed in a medial body portion of the dispensing container and containing a first hair coloring solution therein, an interior recess inwardly extending from a proximal body end portion into the medial body portion and containing a second hair coloring solution therein and having an outer recess surface regions, at least one recess opening formed in the interior recess and extending from interior recess surface regions of the interior recess through the outer recess surface regions of the interior recess and into the inner dispensing container chamber, and a flexible valve recess opening cover positioned over the at least one recess opening to close the at least one recess opening formed in the interior recess to thereby isolate the second hair coloring solution from the first hair coloring solution so that the second hair coloring solution positioned in the interior recess is prevented from readily flowing from the interior recess into the inner dispensing container chamber;

a plunger positioned within the kit container and having a distal plunger end portion positioned in the interior recess adjacent the second hair coloring solution so that positive pressure on the plunger induced by a user opens the flexible valve recess opening cover to allow the first and second hair coloring solutions to mix in the inner dispensing container chamber by passage of the second hair coloring solution from within the interior recess through the at least one recess opening to thereby form a hair color mixture within the inner dispensing container chamber; and a hair color mixture dispenser positioned in the kit container and connected to an open distal body end portion of the dispensing container to dispense hair color mixture therefrom, the hair color mixture dispenser including:

a brush applicator having a proximal brush applicator end including a proximal lengthwise extent and a proximal widthwise extent, a distal brush applicator end including a distal lengthwise extent and a distal widthwise extent whereby the distal widthwise extent is substantially shorter than the proximal widthwise extent, a plurality of hair color mixture extrusion channels positioned between the proximal brush applicator end and the distal brush applicator end, and a plurality of flexible bristles associated with the distal brush applicator end, positioned along the distal lengthwise extent of the distal brush applicator end, and positioned adjacent at least one of the plurality of hair color mixture extrusion channels to provide substantially uniform lengthwise distribution of the hair color mixture, and an extrusion channel closing valve positioned adjacent the open distal body end portion of the container to close the hair color mixture extrusion channels so that the hair color mixture within the inner container chamber is prevented from flowing out of the plurality of hair color mixture extrusion channels.

36. A kit of claim 35, wherein the interior recess comprises a main interior recess including outer main surface regions having an outer main circumference and an auxiliary interior recess including outer auxiliary surface regions having an outer auxiliary circumference substantially smaller than the outer main circumference of the outer main surface regions, and wherein the at least one recess opening is formed in the auxiliary interior recess and extends from auxiliary interior recess surface regions of the auxiliary interior recess into the inner container chamber.

37. A kit of claim 36, wherein the outer main circumference of outer main surface regions of the main interior recess is sized substantially the same as inner circumference of an inner surface regions of the container adjacent the outer main surface regions of the main interior recess to thereby reduce a depth of the interior recess.

38. A kit of claim 35, wherein the at least one recess opening includes a plurality of recess openings, wherein the flexible valve recess opening cover is further positioned in a surrounding relationship over the plurality of recess openings to close the plurality of recess openings formed in the interior recess, and wherein the flexible valve recess opening cover is responsive to the positive pressure applied to the inner recess by the plunger to thereby expand the valve recess cover to uncover the plurality of recess openings to allow the second hair coloring solution to mix with the first hair coloring solution in the inner dispensing container chamber.

39. A kit of claim 35, wherein each of the plurality of hair color mixture extrusion channels adjacent the distal brush applicator end is positioned spaced apart and substantially unobstructed, and wherein each of the plurality of flexible bristles is positioned in a surrounding relationship to at least one of the plurality of hair color mixture extrusion channels to provide concentrated wetting of each of the plurality of flexible bristles positioned therewith to thereby further provide substantially uniform lengthwise dispersion of the dispensed hair color mixture to the hair of the user.

40. A kit of claim 35, wherein the extrusion channel closing valve includes a multi-prong closure cap positioned adjacent the distal brush applicator end and having a plurality of teeth each sealingly positioned within one of the plurality of hair color mixture extrusion channels to selectively close the hair color mixture extrusion channels so that hair color mixture within the inner container chamber is prevented from flowing out of the plurality of hair color mixture extrusion channels.

41. A kit of claim 35, wherein the at least one recess opening includes a plurality of recess openings, wherein the extrusion channel closing valve includes a non-removable rotatable closure cap connected between the open distal body end portion of the container and the proximal brush applicator end of the brush applicator and having a plurality of rotatable closure cap openings in fluid communication with a corresponding plurality of the hair color mixture extrusion channels, and wherein rotating the rotatable closure cap in a first direction allows the hair color mixture to flow through the plurality of rotatable closure cap openings and rotating the rotatable closure cap in a second direction substantially prevents the hair color mixture from flowing through the plurality of rotatable closure cap openings.

42. A method of using an apparatus for coloring hair, the method comprising the steps of:

applying pressure against a first hair color solution contained within an interior recess inwardly extending into an inner container chamber of a container containing a second hair color solution to expand a flexible valve cover positioned in a surrounding relationship over at least one recess opening formed in the interior recess to thereby uncover the at least one recess opening to allow the first and second hair coloring solutions to mix in the inner container chamber to thereby form a hair color mixture within the inner container chamber by passage of the first hair coloring solution from within the interior recess through the plurality of recess openings and into the inner container chamber; and dispensing the hair color mixture by rotating a rotatable closure cap to an open position and squeezing a flexible medial body portion of the container to extrude the hair color mixture onto hair of a user by passage of the hair color mixture from within the inner container chamber through a plurality of hair color mixture extrusion channels and to a plurality of flexible bristles adapted to be brushed through the hair of a user.

43. A method of claim 42, wherein the application of pressure against the first hair color solution is through use of positive pressure on a plunger induced by the user, the plunger having a distal plunger end portion positioned in the interior recess adjacent the first hair coloring solution.

44. A method of claim 43, the method further comprising releasing the application of pressure on the plunger after forming the hair color mixture to thereby contract the flexible valve cover to re-cover the at least one recess opening to prevent the hair color mixture from flowing from the inner container chamber and into the interior recess.

45. A method of providing a kit for coloring hair, the method comprising the steps of:

manufacturing an apparatus for coloring hair including a single container having a medial body portion and an inner container chamber formed in the medial body portion for containing a first hair coloring solution and having an interior recess inwardly extending into the inner container chamber for containing a second hair coloring solution, the apparatus further including a plunger positioned adjacent and in contact with the second hair coloring solution and adapted to be used for applying pressure to the second hair coloring solution to mix the second hair coloring solution into the first hair coloring solution within the inner container chamber, a valve positioned within the inner container chamber in a surrounding relationship over a plurality of recess openings in the interior recess and responsive to a positive pressure on the plunger induced by a user to allow passage of the second hair coloring solution through the plurality of recess openings to allow the second hair coloring solution to mix with the first hair coloring solution in the inner container chamber to form a hair color mixture, and a hair color mixture dispenser connected to the container and including a brush applicator having a plurality of flexible bristles for applying the hair color mixture to the hair of the user and a rotatable closure cap to allow passage of the hair color mixture from within the inner container chamber of the container to the plurality of clusters of flexible bristles; and packaging the apparatus as a combined unit in a single package such that the user can open the package, read any instructions, press the plunger inwardly to mix the first and second hair coloring solutions, rotate the rotatable cap to allow passage of the hair color mixture, and squeeze outer surface regions of the medial body portion to produce a flow of the hair color mixture onto the hair of the user.

* * * * *